US011074920B2

(12) United States Patent
Disch et al.

(10) Patent No.: US 11,074,920 B2
(45) Date of Patent: Jul. 27, 2021

(54) ENCODER, DECODER AND METHODS FOR BACKWARD COMPATIBLE MULTI-RESOLUTION SPATIAL-AUDIO-OBJECT-CODING

(71) Applicant: Fraunhofer-Gesellschaft zur Foerderung der angewandten Forschung e.V., Munich (DE)

(72) Inventors: Sascha Disch, Fuerth (DE); Harald Fuchs, Roettenbach (DE); Jouni Paulus, Erlangen (DE); Leon Terentiv, Erlangen (DE); Oliver Hellmuth, Budenhof (DE); Juergen Herre, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/678,643

(22) Filed: Apr. 3, 2015

(65) Prior Publication Data

US 2015/0213806 A1 Jul. 30, 2015

Related U.S. Application Data

(63) Continuation of application No. PCT/EP2013/070533, filed on Oct. 2, 2013.
(Continued)

(30) Foreign Application Priority Data

May 13, 2013 (EP) ..... 13167485

(51) Int. Cl.
*G10L 19/00* (2013.01)
*G10L 21/00* (2013.01)
(Continued)

(52) U.S. Cl.
CPC ..... *G10L 19/008* (2013.01); *G10L 19/02* (2013.01)

(58) Field of Classification Search
CPC ... G10L 19/008; G10L 19/02; G10L 19/0204; G10L 19/025; G10L 25/06;
(Continued)

(56) References Cited

U.S. PATENT DOCUMENTS

2004/0122662 A1 6/2004 Crockett et al.
2007/0219808 A1 9/2007 Herre et al.
(Continued)

FOREIGN PATENT DOCUMENTS

CN 101578654 A 11/2009
CN 101855918 A 10/2010
(Continued)

OTHER PUBLICATIONS

Bosi, et al., "ISO/IEC MPEG-2 Advanced Audio Coding1", J. Audio Eng. Soc., vol. 45, No. 10, Oct. 1997, pp. 789-814.
(Continued)

*Primary Examiner* — Michael Ortiz-Sanchez
(74) *Attorney, Agent, or Firm* — Perkins Coie LLP; Michael A. Glenn

(57) ABSTRACT

A decoder for generating an un-mixed audio signal including a plurality of un-mixed audio channels is provided. Moreover, an encoder and an encoded audio signal is provided. The decoder includes an un-mixing-information determiner for determining un-mixing information by receiving first parametric side information and second parametric side information on the at least one audio object signal, wherein the frequency resolution of the second parametric side information is higher than that of the first parametric side information. Moreover, the decoder includes an un-mix module for applying the un-mixing information on a down-
(Continued)

mix signal, to obtain an un-mixed audio signal including the plurality of un-mixed audio channels. The un-mixing-information determiner is configured to determine the un-mixing information by modifying the first parametric information and the second parametric information, such that the modified parametric information has a frequency resolution which is higher than the first frequency resolution.

19 Claims, 21 Drawing Sheets

Related U.S. Application Data

(60) Provisional application No. 61/710,128, filed on Oct. 5, 2012.

(51) Int. Cl.
*G10L 19/008* (2013.01)
*G10L 19/02* (2013.01)

(58) Field of Classification Search
CPC ..... G10L 21/0272; G10L 15/02; G10L 15/14; G10L 19/04; G10L 19/20; G10L 25/18; H04S 2420/03; H04S 2400/01; H04S 2400/03; H04S 3/00; H04B 1/1646; H04B 1/405; H04B 1/713; H04B 1/7136; H04L 5/0007
See application file for complete search history.

(56) References Cited

U.S. PATENT DOCUMENTS

| | | | | |
|---|---|---|---|---|
| 2009/0067634 | A1 | 3/2009 | Oh et al. | |
| 2009/0125313 | A1* | 5/2009 | Hellmuth | G10L 19/04 704/501 |
| 2009/0125314 | A1* | 5/2009 | Hellmuth | H04S 3/002 704/501 |
| 2010/0087938 | A1* | 4/2010 | Oh | G10L 19/008 700/94 |
| 2011/0040556 | A1* | 2/2011 | Moon | G10L 19/008 704/205 |
| 2011/0238425 | A1* | 9/2011 | Neuendorf | G10L 19/18 704/500 |
| 2012/0069898 | A1 | 3/2012 | Valin et al. | |
| 2012/0177204 | A1* | 7/2012 | Hellmuth | G10L 19/008 381/22 |
| 2012/0224702 | A1* | 9/2012 | Den Brinker | G10L 19/008 381/22 |
| 2012/0243690 | A1* | 9/2012 | Engdegard | G10L 19/008 381/22 |
| 2014/0074487 | A1 | 3/2014 | Jang et al. | |
| 2015/0287422 | A1* | 10/2015 | Short | G10L 13/02 704/205 |
| 2015/0332684 | A1 | 11/2015 | Oh | |
| 2016/0099002 | A1 | 4/2016 | Ko et al. | |

FOREIGN PATENT DOCUMENTS

| | | | | |
|---|---|---|---|---|
| CN | 102568487 | A | 7/2012 | |
| CN | 102696070 | A | 9/2012 | |
| DE | WO 2009049895 | A1 * | 4/2009 | G10L 19/008 |
| JP | 2010518460 | A1 | 5/2010 | |
| JP | 2010521703 | A | 6/2010 | |
| JP | 2010521866 | A1 | 6/2010 | |
| KR | 1020110082553 | A | 7/2011 | |
| RU | 2236046 | C2 | 9/2004 | |
| WO | 2011047887 | A1 | 4/2011 | |
| WO | 2011155170 | A1 | 12/2011 | |

OTHER PUBLICATIONS

Engdegard, et al., "Spatial Audio Object Coding (SAOC)—The Upcoming MPEG Standard on Parametric Object Based Audio Coding", Presented at the 124th Convention; May 17-20, 2008 Amsterdam, The Netherlands, 15 Pages.

Faller, et al., "Binaural Cue Coding—Part II: Schemes and Applications", IEEE Transactions on Speech and Audio Processing, vol. 11, No. 6, Nov. 2003, pp. 520-531.

Faller, C , ""Parametric Joint-Coding of Audio Sources,"", 120th AES Convention, Paris, France, May 20, 2006, 12 pages.

Girin, Laurent et al., "Informed Audio Source Separation from Compressed Linear Stereo Mixtures".

Herre, et al., "From SAC to SAOC—Recent Developments in Parametric Coding of Spatial Audio", Fraunhofer Institute for Integrated Circuits, Erlangen, Germany.

ISO/IEC 23003-2, "Information technology—MPEG audio technologies—Part 2: Spatial Audio Object Coding (SAOC)".

Liutkus, Antoine et al., "Informed source separation through spectrogram coding and data embedding".

Nesbit, Andrew et al., "Benchmarking Flexible Adaptive Time-Frequency Transforms for Underdetermined Audio Source Separation", 1Electronic Engineering & Computer Science, Queen Mary, University of London, Mile End Road, London, E1 4NS, United Kingdom 2METISS Group, IRISA-INRIA, Campus de Beaulieu, 35042 Rennes Cedex, France.

Ozerov, et al., "Informed source separation: source coding meets source separation", IEEE Workshop on Applications of Signal Processing to Audio and Acoustics; Mohonk, NY, Oct. 2011, 5 pages.

Parvaix, , "A Watermarking-Based Method for Informed Source Separation of Audio Signals With a Single Sensor", IEEE Transactions 0:-.1 Audio. Speecii. And Language Processing. vol. 18, No. 6, Aug. 2010 Mathieu Parvaix, Student Member, IEEE, Laurent Girin, and Jean-Marc Brossier.

Parvaix, Mathieu et al., "Informed Source Separation of Underdetermined Instantaneous Stereo Mixtures Using Source Index Embedding", Grenoble Laboratory of Images, Speech, Signal and Automation (GIPSA-lab) CNRS UMR 5216 , Grenoble Institute of Technology, Grenoble, France.

Zhang, et al., "An informed source separation system for speech signals", HAL archives-ouverts.fr.

Beack, Seungkwon et al., "An Efficient Time-Frequency Representation for Parametric-Based Audio Object Coding", ETRI Journal, Nov. 30, 2011.

Koo, Kyungryeol et al., "Variable Subband Analysis for High Quality Spatial Audio Object Coding", Advanced Communication Technology, 2008.ICACT 2008. 10th International Conference on IEEE, Piscataway, NJ, USA, Feb. 17, 2008.

Falch, Cornelia et al., "Spatial Audio Object Coding With Enhanced Audio Object Separation", Proc. DAFx-10, Austria, IEM,, Sep. 6, 2010, pp. 1-7.

Hellmuth, Oliver et al., "MPEG Spatial Audio Object Coding", The ISO/MPEG Standard for Efficient Coding of Interactive Audio Scenes, Proceedings of the 129th Convention of the Audio Engineering Society, US, AES, Nov. 4, 2010, pp. 1-19.

Herre, J et al., "The Reference Model Architecture for MPEG Spatial Audio Coding", Proc. 118th Convention of the Audio Engineering Society, ES, AES,, May 28, 2005, p. 1-13.

* cited by examiner

ENCODER, DECODER AND METHODS FOR BACKWARD COMPATIBLE MULTI-RESOLUTION SPATIAL-AUDIO-OBJECT-CODING

CROSS-REFERENCE TO RELATED APPLICATIONS

This application is a continuation of copending International Application No. PCT/EP2013/070533, filed Oct. 2, 2013, which is incorporated herein by reference in its entirety, and additionally claims priority from U.S. Application No. 61/710,128, filed Oct. 5, 2012, and from European Application 13 167 485, filed May 13, 2013, which are all incorporated herein by reference in their entirety.

BACKGROUND OF THE INVENTION

The present invention relates to audio signal encoding, audio signal decoding and audio signal processing, and, in particular, to an encoder, a decoder and methods for backward compatible multi-resolution spatial audio object coding (SAOC).

In modern digital audio systems, it is a major trend to allow for audio-object related modifications of the transmitted content on the receiver side. These modifications include gain modifications of selected parts of the audio signal and/or spatial re-positioning of dedicated audio objects in case of multi-channel playback via spatially distributed speakers. This may be achieved by individually delivering different parts of the audio content to the different speakers.

In other words, in the art of audio processing, audio transmission, and audio storage, there is an increasing desire to allow for user interaction on object-oriented audio content playback and also a demand to utilize the extended possibilities of multi-channel playback to individually render audio contents or parts thereof in order to improve the hearing impression. By this, the usage of multi-channel audio content brings along significant improvements for the user. For example, a three-dimensional hearing impression can be obtained, which brings along an improved user satisfaction in entertainment applications. However, multi-channel audio content is also useful in professional environments, for example in telephone conferencing applications, because the talker intelligibility can be improved by using a multi-channel audio playback. Another possible application is to offer to a listener of a musical piece to individually adjust playback level and/or spatial position of different parts (also termed as "audio objects") or tracks, such as a vocal part or different instruments. The user may perform such an adjustment for reasons of personal taste, for easier transcribing one or more part(s) from the musical piece, educational purposes, karaoke, rehearsal, etc.

The straightforward discrete transmission of all digital multi-channel or multi-object audio content, e.g., in the form of pulse code modulation (PCM) data or even compressed audio formats, demands very high bitrates. However, it is also desirable to transmit and store audio data in a bit rate efficient way. Therefore, one is willing to accept a reasonable tradeoff between audio quality and bit rate requirements in order to avoid an excessive resource load caused by multi-channel/multi-object applications.

Recently, in the field of audio coding, parametric techniques for the bit rate-efficient transmission/storage of multi-channel/multi-object audio signals have been introduced by, e.g., the Moving Picture Experts Group (MPEG) and others. One example is MPEG Surround (MPS) as a channel oriented approach [MPS, BCC], or MPEG Spatial Audio Object Coding (SAOC) as an object oriented approach [JSC, SAOC, SAOC1, SAOC2]. Another object—oriented approach is termed as "informed source separation" [ISS1, ISS2, ISS3, ISS4, ISS5, ISS6]. These techniques aim at reconstructing a desired output audio scene or a desired audio source object on the basis of a downmix of channels/objects and additional side information describing the transmitted/stored audio scene and/or the audio source objects in the audio scene.

The estimation and the application of channel/object related side information in such systems is done in a time-frequency selective manner. Therefore, such systems employ time-frequency transforms such as the Discrete Fourier Transform (DFT), the Short Time Fourier Transform (STFT) or filter banks like Quadrature Mirror Filter (QMF) banks, etc. The basic principle of such systems is depicted in FIG. 4, using the example of MPEG SAOC.

In case of the STFT, the temporal dimension is represented by the time-block number and the spectral dimension is captured by the spectral coefficient ("bin") number. In case of QMF, the temporal dimension is represented by the time-slot number and the spectral dimension is captured by the sub-band number. If the spectral resolution of the QMF is improved by subsequent application of a second filter stage, the entire filter bank is termed hybrid QMF and the fine resolution sub-bands are termed hybrid sub-bands.

As already mentioned above, in SAOC the general processing is carried out in a time-frequency selective way and can be described as follows within each frequency band:

- N input audio object signals $s_1 \ldots s_N$ are mixed down to P channels $x_1 \ldots x_P$ as part of the encoder processing using a downmix matrix consisting of the elements $d_{1,1} \ldots d_{N,P}$. In addition, the encoder extracts side information describing the characteristics of the input audio objects (Side Information Estimator (SIE) module). For MPEG SAOC, the relations of the object powers w.r.t. each other are the most basic form of such a side information.
- Downmix signal(s) and side information are transmitted/stored. To this end, the downmix audio signal(s) may be compressed, e.g., using well-known perceptual audio coders such MPEG-1/2 Layer II or III (aka .mp3), MPEG-2/4 Advanced Audio Coding (AAC) etc.
- On the receiving end, the decoder conceptually tries to restore the original object signals ("object separation") from the (decoded) downmix signals using the transmitted side information. These approximated object signals $\hat{s}_1 \ldots \hat{s}_N$ are then mixed into a target scene represented by M audio output channels $\hat{y}_1 \ldots \hat{y}_M$ using a rendering matrix described by the coefficients $r_{1,1} \ldots r_{N,M}$ in FIG. 4. The desired target scene may be, in the extreme case, the rendering of only one source signal out of the mixture (source separation scenario), but also any other arbitrary acoustic scene consisting of the objects transmitted. For example, the output can be a single-channel, a 2-channel stereo or 5.1 multi-channel target scene.

Time-frequency based systems may utilize a time-frequency (t/f) transform with static temporal and frequency resolution. Choosing a certain fixed t/f-resolution grid typically involves a trade-off between time and frequency resolution.

The effect of a fixed t/f-resolution can be demonstrated on the example of typical object signals in an audio signal mixture. For example, the spectra of tonal sounds exhibit a harmonically related structure with a fundamental frequency and several overtones. The energy of such signals is concentrated at certain frequency regions. For such signals, a high frequency resolution of the utilized t/f-representation is beneficial for separating the narrowband tonal spectral regions from a signal mixture. In the contrary, transient signals, like drum sounds, often have a distinct temporal structure: substantial energy is only present for short periods of time and is spread over a wide range of frequencies. For these signals, a high temporal resolution of the utilized t/f-representation is advantageous for separating the transient signal portion from the signal mixture.

The frequency resolution obtained from the standard SAOC representation is limited to the number of parametric bands, having the maximum value of 28 in standard SAOC. They are obtained from a hybrid QMF bank consisting of a 64-band QMF-analysis with an additional hybrid filtering stage on the lowest bands further dividing these into up to 4 complex sub-bands. The frequency bands obtained are grouped into parametric bands mimicking the critical band resolution of the human auditory system. The grouping allows for reducing the necessitated side information data rate to a size that can be efficiently handled in practical applications.

Current audio object coding schemes offer only a limited variability in the time-frequency selectivity of the SAOC processing. For instance, MPEG SAOC [SAOC] [SAOC1] [SAOC2] is limited to the time-frequency resolution that can be obtained by the use of the so-called Hybrid Quadrature Mirror Filter Bank (Hybrid-QMF) and its subsequent grouping into parametric bands. Therefore, object restoration in standard SAOC often suffers from the coarse frequency resolution of the Hybrid-QMF leading to audible modulated crosstalk from the other audio objects (e.g., double-talk artifacts in speech or auditory roughness artifacts in music).

The existing system produces a reasonable separation quality given the reasonably low data rate. The main problem is the insufficient frequency resolution for a clean separation of tonal sounds. This is exhibited as a "halo" of other objects surrounding the tonal components of an object. Perceptually this is observed as roughness or a vocoder-like artefact. The detrimental effect of this halo can be reduced by increasing the parametric frequency resolution. It was noted, that a resolution equal or higher than 512 bands (at 44.1 kHz sampling rate) is enough to produce perceptually significantly improved separation in the test signals. The problem with such a high parametric resolution is that the amount the side information needed increases considerably, into impractical amounts. Furthermore, the compatibility with the existing standard SAOC systems would be lost.

It is therefore highly appreciated, if concepts can be provided which teach how to overcome the above-described restrictions of the state of the art.

SUMMARY

According to an embodiment, a decoder for generating an un-mixed audio signal including a plurality of un-mixed audio channels may have: an un-mixing-information determiner for determining un-mixing information by receiving first parametric side information on the at least one audio object signal and second parametric side information on the at least one audio object signal, wherein the frequency resolution of the second parametric side information is higher than the frequency resolution of the first parametric side information, and an un-mix module for applying the un-mixing information on a downmix signal, indicating a downmix of at least one audio object signal, to obtain an un-mixed audio signal including the plurality of un-mixed audio channels, wherein the un-mixing-information determiner is configured to determine the un-mixing information by modifying the first parametric information and the second parametric information to obtain modified parametric information, such that the modified parametric information has a frequency resolution which is higher than the first frequency resolution.

According to another embodiment, an encoder for encoding one or more input audio object signals may have: a downmix unit for downmixing the one or more input audio object signals to obtain one or more downmix signals, and a parametric-side-information generator for generating first parametric side information on the at least one audio object signal and second parametric side information on the at least one audio object signal, such that the frequency resolution of the second parametric side information is higher than the frequency resolution of the first parametric side information.

According to another embodiment, an encoded audio signal may have: a downmix portion indicating a downmix of one or more input audio object signals, a parametric side information portion including first parametric side information on the at least one audio object signal and second parametric side information on the at least one audio object signal, wherein the frequency resolution of the second parametric side information is higher than the frequency resolution of the first parametric side information.

According to another embodiment, a system may have: an inventive encoder for encoding one or more input audio object signals by obtaining one or more downmix signals indicating a downmix of one or more input audio object signals, by obtaining first parametric side information on the at least one audio object signal, and by obtaining second parametric side information on the at least one audio object signal, wherein the frequency resolution of the second parametric side information is higher than the frequency resolution of the first parametric side information, and an inventive decoder for generating an un-mixed audio signal based on the one or more downmix signals, and based on the first parametric side information and the second parametric side information.

According to another embodiment, a method for generating an un-mixed audio signal including a plurality of un-mixed audio channels may have the steps of: determining un-mixing information by receiving first parametric side information on the at least one audio object signal and second parametric side information on the at least one audio object signal, wherein the frequency resolution of the second parametric side information is higher than the frequency resolution of the first parametric side information, and applying the un-mixing information on a downmix signal, indicating a downmix of at least one audio object signal, to obtain an un-mixed audio signal including the plurality of un-mixed audio channels, wherein determining the un-mixing information includes modifying the first parametric information and the second parametric information to obtain modified parametric information, such that the modified parametric information has a frequency resolution which is higher than the first frequency resolution.

According to another embodiment, a method for encoding one or more input audio object signals may have the steps of: downmixing the one or more input audio object signals to obtain one or more downmix signals, and generating first parametric side information on the at least one audio object signal and second parametric side information on the at least one audio object signal, such that the frequency resolution of the second parametric side information is higher than the frequency resolution of the first parametric side information.

Another embodiment may have a computer program for implementing the inventive methods when being executed on a computer or signal processor.

In contrast to state-of-the-art SAOC, embodiments of the present invention provide a spectral parameterization, such that

- the SAOC parameter bit streams originating from a standard SAOC encoder can still be decoded by an enhanced decoder with a perceptual quality comparable to the one obtained with a standard decoder,
- the enhanced SAOC parameter bit streams can be decoded with a standard SAOC decoder with a quality comparable to the one obtainable with standard SAOC bit streams,
- the enhanced SAOC parameter bit streams can be decoded with optimal quality with the enhanced decoder,
- the enhanced SAOC decoder can dynamically adjust the enhancement level, e.g., depending on the computational resources available,
- the standard and enhanced SAOC parameter bit streams can be mixed, e.g., in a multi-point control unit (MCU) scenario, into one common bit stream which can be decoded with a standard or an enhanced decoder with the quality provided by the decoder, and
- the additional parameterization is compact.

For the properties mentioned above, it is advantageous to have a parameterization which is understood by the standard SAOC decoder, but also allows for an efficient delivery of the information in the higher frequency resolution. The resolution of the underlying time-frequency representation determines the maximum performance of the enhancements. The invention here defines a method for delivering the enhanced high-frequency information in a way which is compact and allows a backwards compatible decoding.

An enhanced SAOC perceptual quality can be obtained, e.g., by dynamically adapting the time/frequency resolution of the filter bank or transform that is employed to estimate or used to synthesize the audio object cues to specific properties of the input audio object. For instance, if the audio object is quasi-stationary during a certain time span, parameter estimation and synthesis is beneficially performed on a coarse time resolution and a fine frequency resolution. If the audio object contains transients or non-stationaries during a certain time span, parameter estimation and synthesis is advantageously done using a fine time resolution and a coarse frequency resolution. Thereby, the dynamic adaptation of the filter bank or transform allows for

- a high frequency selectivity in the spectral separation of quasi-stationary signals in order to avoid inter-object crosstalk, and
- high temporal precision for object onsets or transient events in order to minimize pre- and post-echoes.

At the same time, traditional SAOC quality can be obtained by mapping standard SAOC data onto the time-frequency grid provided by the inventive backward compatible signal adaptive transform that depends on side information describing the object signal characteristics.

Being able to decode both standard and enhanced SAOC data, using one common transform, enables direct backward compatibility for applications that encompass mixing of standard and novel enhanced SAOC data. It also allows a time-frequency selective enhancement over the standard quality.

The provided embodiments are not limited to any specific time-frequency transform, but can be applied with any transform providing sufficiently high frequency resolution. The document describes the application to a Discrete Fourier Transform (DFT) based filter bank with switched time-frequency resolution. In this approach, the time domain signals are subdivided into shorter blocks, which also may overlap. The signal in each shorter block is weighted by a windowing function (normally having large values in the middle and at both ends tapered into zero). Finally the weighted signal is transformed into frequency domain by the selected transform, here, by application of the DFT.

A decoder for generating an un-mixed audio signal comprising a plurality of un-mixed audio channels is provided. The decoder comprises an un-mixing-information determiner for determining un-mixing information by receiving first parametric side information on the at least one audio object signal and second parametric side information on the at least one audio object signal, wherein the frequency resolution of the second parametric side information is higher than the frequency resolution of the first parametric side information. Moreover, the decoder comprises an un-mix module for applying the un-mixing information on a downmix signal, indicating a downmix of at least one audio object signal, to obtain an un-mixed audio signal comprising the plurality of un-mixed audio channels. The un-mixing-information determiner is configured to determine the un-mixing information by modifying the first parametric information and the second parametric information to obtain modified parametric information, such that the modified parametric information has a frequency resolution which is higher than the first frequency resolution.

Moreover, an encoder for encoding one or more input audio object signals is provided. The encoder comprises a downmix unit for downmixing the one or more input audio object signals to obtain one or more downmix signals. Furthermore, the encoder comprises a parametric-side-information generator for generating first parametric side information on the at least one audio object signal and second parametric side information on the at least one audio object signal, such that the frequency resolution of the second parametric side information is higher than the frequency resolution of the first parametric side information.

Furthermore, an encoded audio signal is provided. The encoded audio signal comprises a downmix portion, indicating a downmix of one or more input audio object signals, and a parametric side information portion comprising first parametric side information on the at least one audio object signal and second parametric side information on the at least one audio object signal. The frequency resolution of the second parametric side information is higher than the frequency resolution of the first parametric side information.

Moreover, a system is provided. The system comprises an encoder as described above and a decoder as described above. The encoder is configured to encode one or more input audio object signals by obtaining one or more downmix signals indicating a downmix of one or more input audio object signals, by obtaining first parametric side information on the at least one audio object signal, and by obtaining second parametric side information on the at least one audio object signal, wherein the frequency resolution of the second parametric side information is higher than the frequency resolution of the first parametric side information. The decoder is configured to generate an un-mixed audio signal based on the one or more downmix signals, and based on the first parametric side information and the second parametric side information.

The encoder is configured to encode one or more input audio object signals by obtaining one or more downmix signals indicating a downmix of one or more input audio object signals, by obtaining first parametric side information on the at least one audio object signal, and by obtaining second parametric side information on the at least one audio object signal, wherein the frequency resolution of the second parametric side information is higher than the frequency resolution of the first parametric side information. The decoder is configured to generate an audio output signal based on the one or more downmix signals, and based on the first parametric side information and the second parametric side information.

Furthermore, a method for generating an un-mixed audio signal comprising a plurality of un-mixed audio channels is provided. The method comprises:

Determining un-mixing information by receiving first parametric side information on the at least one audio object signal and second parametric side information on the at least one audio object signal, wherein the frequency resolution of the second parametric side information is higher than the frequency resolution of the first parametric side information. And:

Applying the un-mixing information on a downmix signal, indicating a downmix of at least one audio object signal, to obtain an un-mixed audio signal comprising the plurality of un-mixed audio channels.

Determining the un-mixing information comprises modifying the first parametric information and the second parametric information to obtain modified parametric information, such that the modified parametric information has a frequency resolution which is higher than the first frequency resolution.

Moreover, a method for encoding one or more input audio object signals is provided. The method comprises:

Downmixing the one or more input audio object signals to obtain one or more downmix signals. And:

Generating first parametric side information on the at least one audio object signal and second parametric side information on the at least one audio object signal, such that the frequency resolution of the second parametric side information is higher than the frequency resolution of the first parametric side information.

Moreover, a computer program for implementing one of the above-described methods when being executed on a computer or signal processor is provided.

BRIEF DESCRIPTION OF THE DRAWINGS

Embodiments of the present invention will be detailed subsequently referring to the appended drawings, in which.

DETAILED DESCRIPTION OF THE INVENTION

Before describing embodiments of the present invention, more background on state-of-the-art-SAOC systems is provided.

Figure 4:
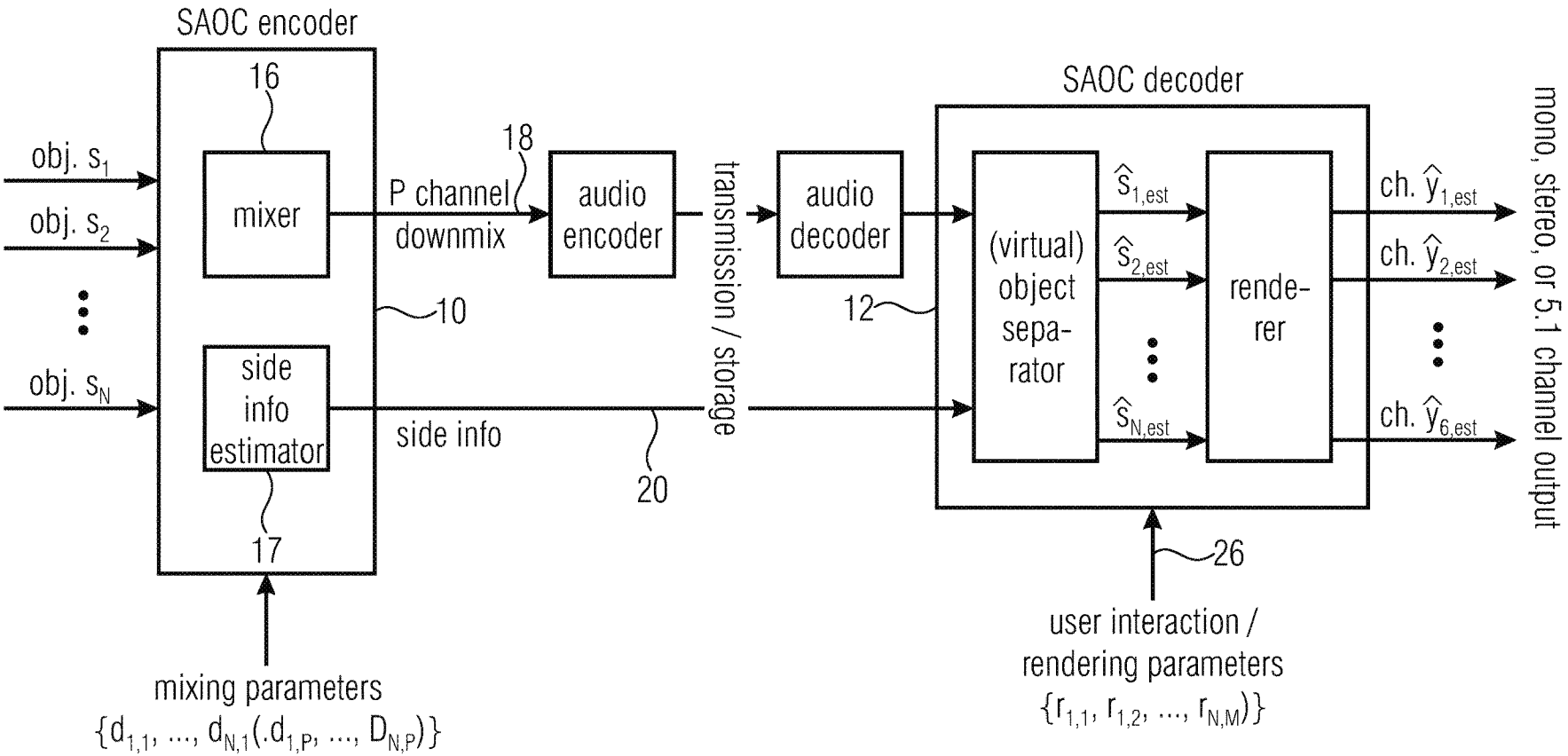
FIG. 4 shows a schematic block diagram of a conceptual overview of an SAOC system.

FIG. 4 shows a general arrangement of an SAOC encoder 10 and an SAOC decoder 12. The SAOC encoder 10 receives as an input N objects, i.e., audio signals $s_1$ to $s_N$. In particular, the encoder 10 comprises a downmixer 16 which receives the audio signals $s_1$ to $s_N$ and downmixes same to a downmix signal 18. Alternatively, the downmix may be provided externally ("artistic downmix") and the system estimates additional side information to make the provided downmix match the calculated downmix. In FIG. 4, the downmix signal is shown to be a P-channel signal. Thus, any mono (P=1), stereo (P=2) or multi-channel (P>2) downmix signal configuration is conceivable.

In the case of a stereo downmix, the channels of the downmix signal 18 are denoted L0 and R0, in case of a mono downmix same is simply denoted L0. In order to enable the SAOC decoder 12 to recover the individual objects $s_j$ to $s_N$, side-information estimator 17 provides the SAOC decoder 12 with side information including SAOC-parameters. For example, in case of a stereo downmix, the SAOC parameters comprise object level differences (OLD), inter-object correlations (IOC) (inter-object cross correlation parameters), downmix gain values (DMG) and downmix channel level differences (DCLD). The side information 20 including the SAOC-parameters, along with the downmix signal 18, forms the SAOC output data stream received by the SAOC decoder 12.

The SAOC decoder 12 comprises an upmixer which receives the downmix signal 18 as well as the side information 20 in order to recover and render the audio signals $\hat{s}_1$ and $\hat{s}_N$ onto any user-selected set of channels $\hat{y}_1$ to $\hat{y}_M$, with the rendering being prescribed by rendering information 26 input into SAOC decoder 12.

The audio signals $s_1$ to $s_N$ may be input into the encoder 10 in any coding domain, such as, in time or spectral domain. In case the audio signals $s_1$ to $s_N$ are fed into the encoder 10 in the time domain, such as PCM coded, encoder 10 may use a filter bank, such as a hybrid QMF bank, in order to transfer the signals into a spectral domain, in which the audio signals are represented in several sub-bands associated with different spectral portions, at a specific filter bank resolution. If the audio signals $s_1$ to $s_N$ are already in the representation expected by encoder 10, same does not have to perform the spectral decomposition.

Figure 5:
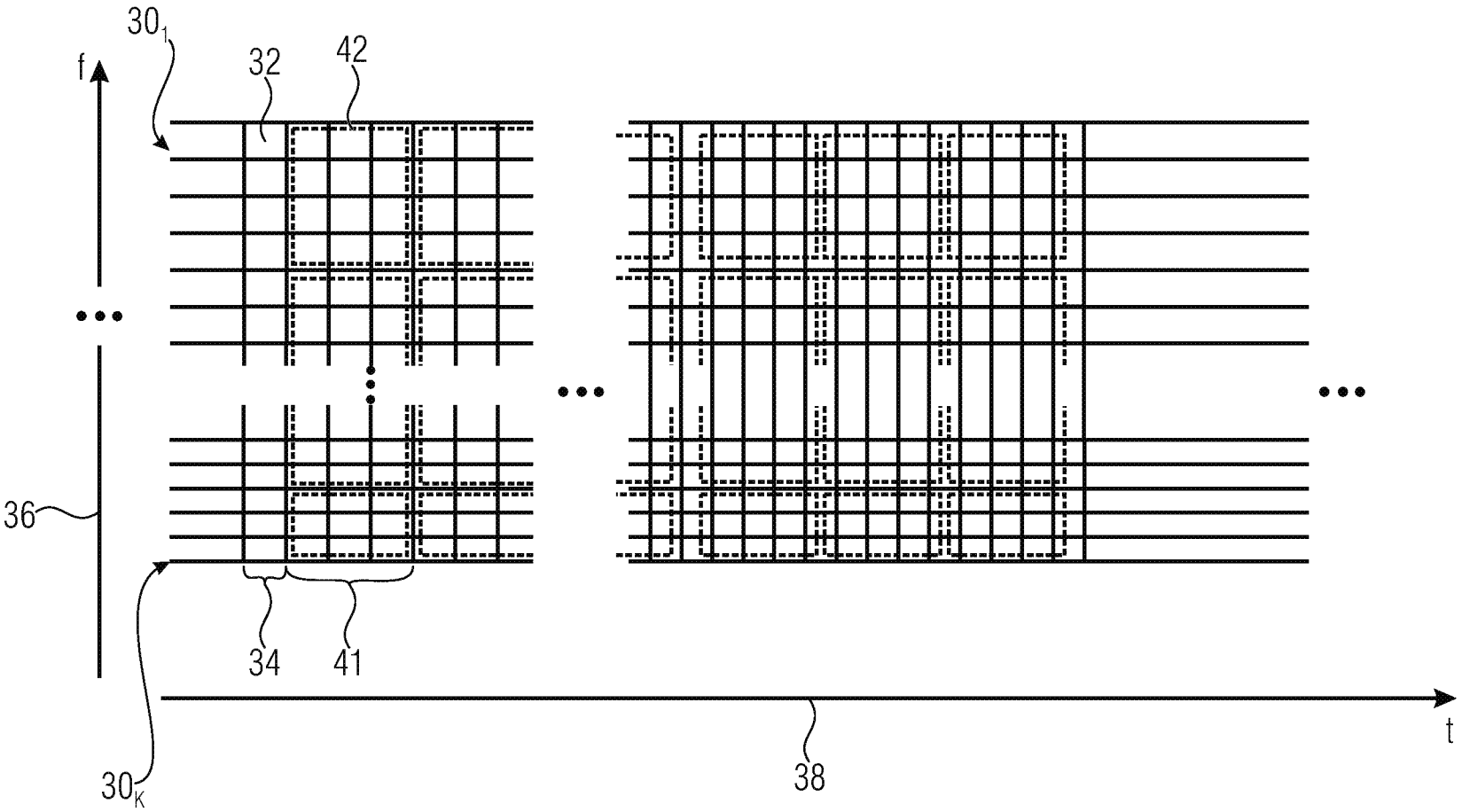
FIG. 5 shows a schematic and illustrative diagram of a temporal-spectral representation of a single-channel audio signal.

FIG. 5 shows an audio signal in the just-mentioned spectral domain. As can be seen, the audio signal is represented as a plurality of sub-band signals. Each sub-band signal $\mathbf{30}_1$ to $\mathbf{30}_K$ consists of a temporal sequence of sub-band values indicated by the small boxes 32. As can be seen, the sub-band values 32 of the sub-band signals $\mathbf{30}_1$ to $\mathbf{30}_K$ are synchronized to each other in time so that, for each of the consecutive filter bank time slots 34, each sub-band $\mathbf{30}_1$ to $\mathbf{30}_K$ comprises exact one sub-band value 32. As illustrated by the frequency axis 36, the sub-band signals $\mathbf{30}_1$ to $\mathbf{30}_K$ are associated with different frequency regions, and as illustrated by the time axis 38, the filter bank time slots 34 are consecutively arranged in time.

As outlined above, side-information extractor 17 of FIG. 4 computes SAOC-parameters from the input audio signals $s_1$ to $s_N$. According to the currently implemented SAOC standard, encoder 10 performs this computation in a time/frequency resolution which may be decreased relative to the original time/frequency resolution as determined by the filter bank time slots 34 and sub-band decomposition, by a certain amount, with this certain amount being signaled to the decoder side within the side information 20. Groups of consecutive filter bank time slots 34 may form a SAOC frame 41. Also the number of parameter bands within the SAOC frame 41 is conveyed within the side information 20. Hence, the time/frequency domain is divided into time/frequency tiles exemplified in FIG. 5 by dashed lines 42. In FIG. 5 the parameter bands are distributed in the same manner in the various depicted SAOC frames 41 so that a regular arrangement of time/frequency tiles is obtained. In general, however, the parameter bands may vary from one SAOC frame 41 to the subsequent, depending on the different needs for spectral resolution in the respective SAOC frames 41. Furthermore, the length of the SAOC frames 41 may vary, as well. As a consequence, the arrangement of time/frequency tiles may be irregular. Nevertheless, the time/frequency tiles within a particular SAOC frame 41 typically have the same duration and are aligned in the time direction, i.e., all t/f-tiles in said SAOC frame 41 start at the start of the given SAOC frame 41 and end at the end of said SAOC frame 41.

The side information extractor 17 depicted in FIG. 4 calculates SAOC parameters according to the following formulas. In particular, side information extractor 17 computes object level differences for each object i as $$OLD_i^{l,m} = \frac{\sum_{n\in l}\sum_{k\in m} x_i^{n,k} x_i^{n,k*}}{\max_j\left(\sum_{n\in l}\sum_{k\in m} x_j^{n,k} x_j^{n,k*}\right)}$$

wherein the sums and the indices n and k, respectively, go through all temporal indices 34, and all spectral indices 30 which belong to a certain time/frequency tile 42, referenced by the indices l for the SAOC frame (or processing time slot) and m for the parameter band, and $x_i^{n,k*}$ is the complex conjugate of $x_i^{n,k}$. Thereby, the energies of all sub-band values $x_i$ of an audio signal or object i are summed up and normalized to the highest energy value of that tile among all objects or audio signals.

Further, the SAOC side information extractor 17 is able to compute a similarity measure of the corresponding time/frequency tiles of pairs of different input objects $s_1$ to $s_N$. Although the SAOC side information extractor 17 may compute the similarity measure between all the pairs of input objects $s_1$ to $s_N$, SAOC side information extractor 17 may also suppress the signaling of the similarity measures or restrict the computation of the similarity measures to audio objects $s_1$ to $s_N$ which form left or right channels of a common stereo channel. In any case, the similarity measure is called the inter-object cross-correlation parameter $IOC_{i,j}^{l,m}$. The computation is as follows $$IOC_{i,j}^{l,m} = IOC_{j,i}^{l,m} = \mathrm{Re}\left\{\frac{\sum_{n\in l}\sum_{k\in m} x_i^{n,k} x_j^{n,k*}}{\sqrt{\sum_{n\in l}\sum_{k\in m} x_i^{n,k} x_i^{n,k*} \sum_{n\in l}\sum_{k\in m} x_j^{n,k} x_j^{n,k*}}}\right\}$$

with again indices n and k going through all sub-band values belonging to a certain time/frequency tile 42, i and j denoting a certain pair of audio objects $s_1$ to $s_N$, and Re{ } denoting the operation of retaining only the real part (i.e., discarding the imaginary part) of the complex-valued argument.

The downmixer 16 of FIG. 4 downmixes the objects $s_1$ to $s_N$ by use of gain factors applied to each object $s_1$ to $s_N$. That is, a gain factor $d_i$ is applied to object i and then all thus weighted objects $s_1$ to $s_N$ are summed up to obtain a mono downmix signal, which is exemplified in FIG. 4 if P=1. In another example case of a two-channel downmix signal, depicted in FIG. 4 if P=2, a gain factor $d_{1,i}$ is applied to object i and then all such gain amplified objects are summed in order to obtain the left downmix channel L0, and gain factors $d_{2,i}$ are applied to object i and then the thus gain-amplified objects are summed in order to obtain the right downmix channel R0. A processing that is analogous to the above is to be applied in case of a multi-channel downmix (P>2).

This downmix prescription is signaled to the decoder side by means of down mix gains $DMG_i$ and, in case of a stereo downmix signal, downmix channel level differences $DCLD_i$.

The downmix gains are calculated according to:

$$DMG_i = 20\log_{10}(d_i+\varepsilon), \text{(mono downmix)},$$

$$DMG_i = 10\log_{10}(d_{1,i}^2+d_{2,i}^2+\varepsilon), \text{(stereo downmix)},$$

where ε is a small number such as $10^{-9}$.

For the DCLDs the following formula applies:

$$DCLD_i = 20\log_{10}\left(\frac{d_{1,i}}{d_{2,i}+\varepsilon}\right).$$

In the normal mode, downmixer 16 generates the downmix signal according to:

$$(L0) = (d_i)\begin{pmatrix} s_1 \\ \vdots \\ s_N \end{pmatrix}$$

for a mono downmix, or $$\begin{pmatrix} L0 \\ R0 \end{pmatrix} = \begin{pmatrix} d_{1,i} \\ d_{2,i} \end{pmatrix}\begin{pmatrix} s_1 \\ \vdots \\ s_N \end{pmatrix}$$

for a stereo downmix, respectively.

Thus, in the abovementioned formulas, parameters OLD and IOC are a function of the audio signals, and parameters DMG and DCLD are functions of the downmix coefficients d. By the way, it is noted that d may be varying in time and frequency.

Thus, in the normal mode, downmixer 16 mixes all objects $s_1$ to $s_N$ with no preferences, i.e., with handling all objects $s_1$ to $s_N$ equally.

At the decoder side, the upmixer performs the inversion of the downmix procedure and the implementation of the "rendering information" 26 represented by a matrix R (in the literature sometimes also called A) in one computation step, namely, in case of a two-channel downmix $$\begin{pmatrix} \hat{y}_1 \\ \vdots \\ \hat{y}_M \end{pmatrix} = RED^*(DED^*)^{-1}\begin{pmatrix} L0 \\ R0 \end{pmatrix},$$

where matrix E is a function of the parameters OLD and IOC, and the matrix D contains the downmixing coefficients as $$D = \begin{pmatrix} d_{1,1} & \dots & d_{1,N} \\ \vdots & \ddots & \vdots \\ d_{P,1} & \dots & d_{P,N} \end{pmatrix},$$

and wherein D* denotes the complex transpose of D. The matrix E is an estimated covariance matrix of the audio objects $s_1$ to $s_N$. In current SAOC implementations, the computation of the estimated covariance matrix E is typically performed in the spectral/temporal resolution of the SAOC parameters, i.e., for each (l,m), so that the estimated covariance matrix may be written as $E^{l,m}$. The estimated covariance matrix $E^{l,m}$ is of size N×N with its coefficients being defined as $$e_{i,j}^{l,m} = \sqrt{OLD_i^{l,m} OLD_j^{l,m}}\, IOC_{i,j}^{l,m}.$$

Thus, the matrix $E^{l,m}$ with $$E^{l,m} = \begin{pmatrix} e_{1,1}^{l,m} & \dots & e_{1,N}^{l,m} \\ \vdots & \ddots & \vdots \\ e_{N,1}^{l,m} & \dots & e_{N,N}^{l,m} \end{pmatrix}$$

has along its diagonal the object level differences, i.e., $e_{i,j}^{l,m} = OLD_i^{l,m}$ for i=j, since $OLD_i^{l,m} = OLD_j^{l,m}$ and $IOC_{i,j}^{l,m} = 1$ for i=j. Outside its diagonal the estimated covariance matrix E has matrix coefficients representing the geometric mean of the object level differences of objects i and j, respectively, weighted with the inter-object cross correlation measure $IOC_{i,j}^{l,m}$.

Figure 6:
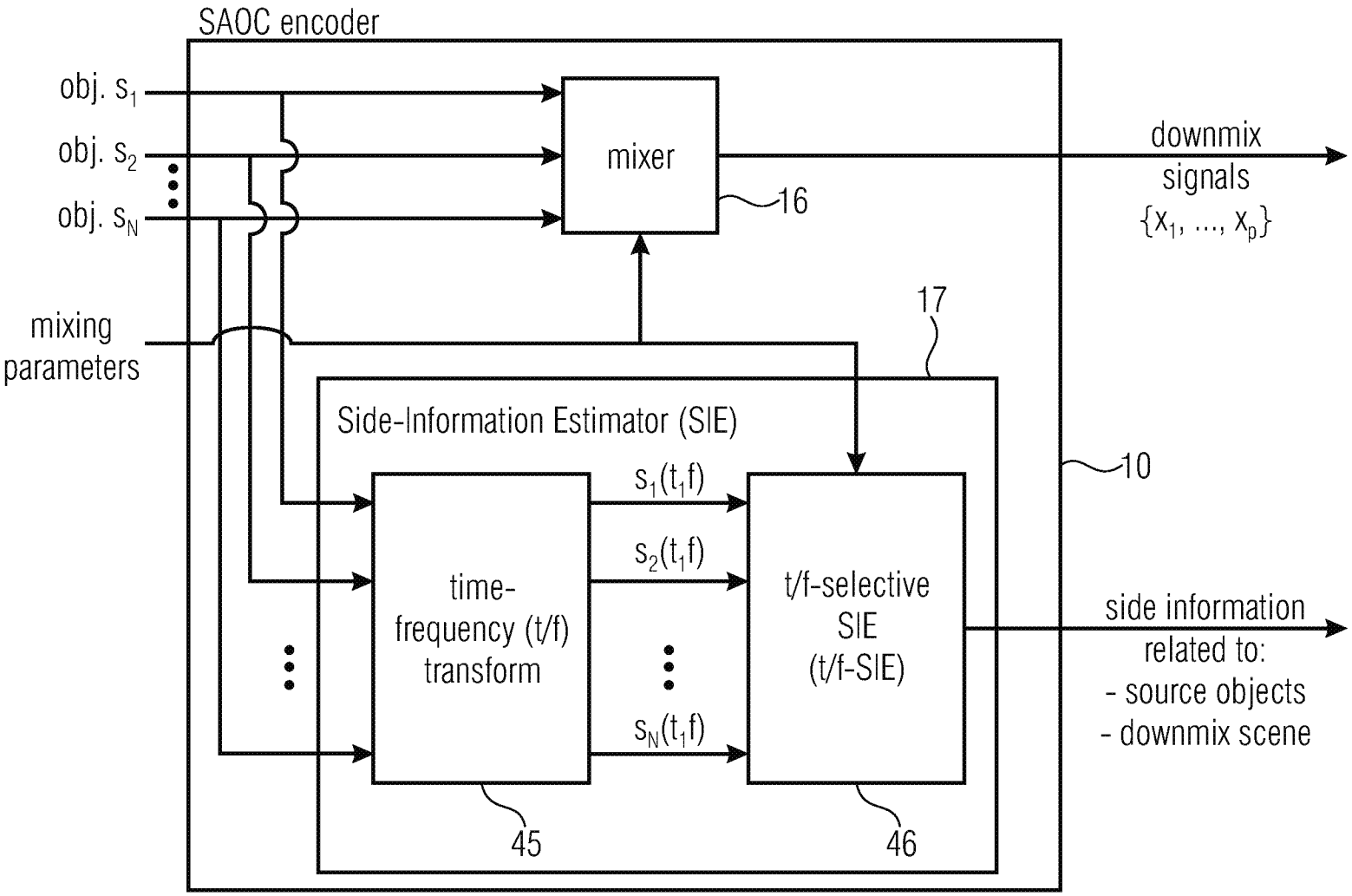
FIG. 6 shows a schematic block diagram of a time-frequency selective computation of side information within an SAOC encoder.

FIG. 6 displays one possible principle of implementation on the example of the Side Information Estimator (SIE) as part of a SAOC encoder 10. The SAOC encoder 10 comprises the mixer 16 and the Side Information Estimator (SIE) 17. The SIE conceptually consists of two modules: One module 45 to compute a short-time based t/f-representation (e.g., STFT or QMF) of each signal. The computed short-time t/f-representation is fed into the second module 46, the t/f-selective Side Information Estimation module (t/f-SIE). The t/f-SIE module 46 computes the side information for each t/f-tile. In current SAOC implementations, the time/frequency transform is fixed and identical for all audio objects $s_1$ to $s_N$. Furthermore, the SAOC parameters are determined over SAOC frames which are the same for all audio objects and have the same time/frequency resolution for all audio objects $s_1$ to $s_N$, thus disregarding the object-specific needs for fine temporal resolution in some cases or fine spectral resolution in other cases.

In the following, embodiments of the present invention are described.

Figure 1A:
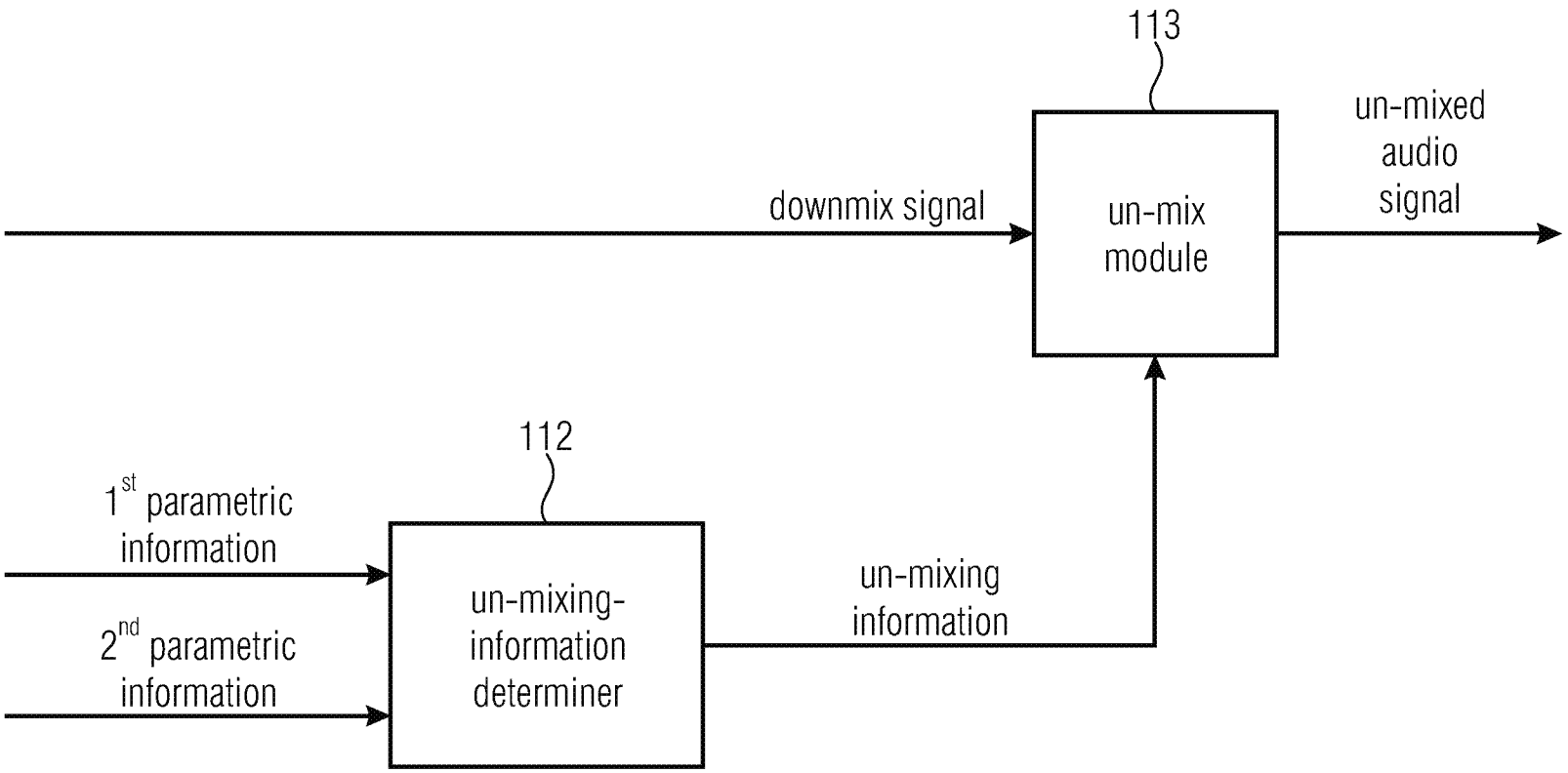
FIG. 1*a* illustrates a decoder according to an embodiment.

FIG. 1*a* illustrates a decoder for generating an un-mixed audio signal comprising a plurality of un-mixed audio channels according to an embodiment.

The decoder comprises an un-mixing-information determiner 112 for determining un-mixing information by receiving first parametric side information on the at least one audio object signal and second parametric side information on the at least one audio object signal, wherein the frequency resolution of the second parametric side information is higher than the frequency resolution of the first parametric side information.

Moreover, the decoder comprises an un-mix module 113 for applying the un-mixing information on a downmix signal, indicating a downmix of at least one audio object signal, to obtain an un-mixed audio signal comprising the plurality of un-mixed audio channels.

The un-mixing-information determiner 112 is configured to determine the un-mixing information by modifying the first parametric information and the second parametric information to obtain modified parametric information, such that the modified parametric information has a frequency resolution which is higher than the first frequency resolution.

Figure 1B:
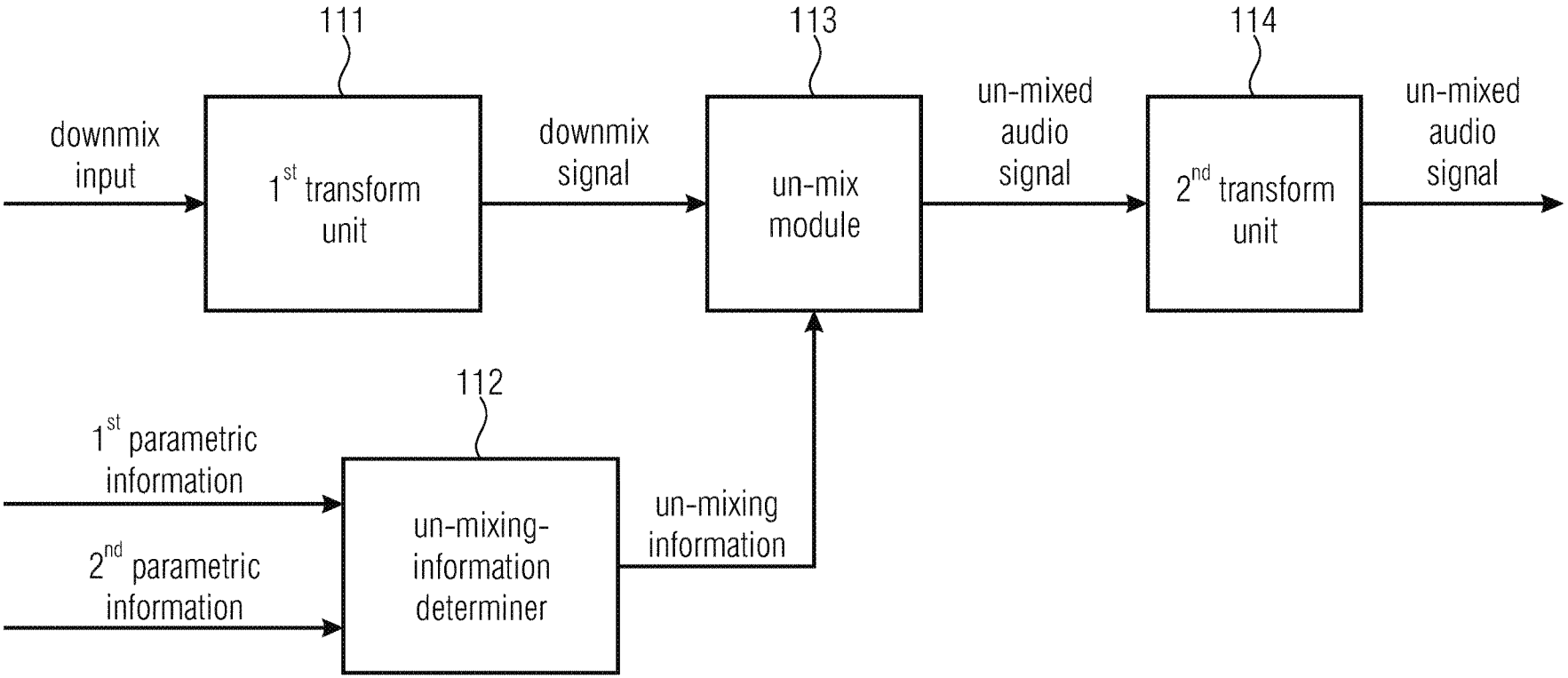
FIG. 1*b* illustrates a decoder according to another embodiment.

FIG. 1*b* illustrates a decoder for generating an un-mixed audio signal comprising a plurality of un-mixed audio channels according to another embodiment. The decoder of FIG. 1*b* furthermore comprises a first transform unit 111 for transforming a downmix input, being represented in a time domain, to obtain the downmix signal, being represented in a time-frequency domain. Furthermore, the decoder of FIG.

1*b* comprises a second transform unit 114 for transforming the un-mixed audio signal from the time-frequency domain to the time domain.

Figure 2A:
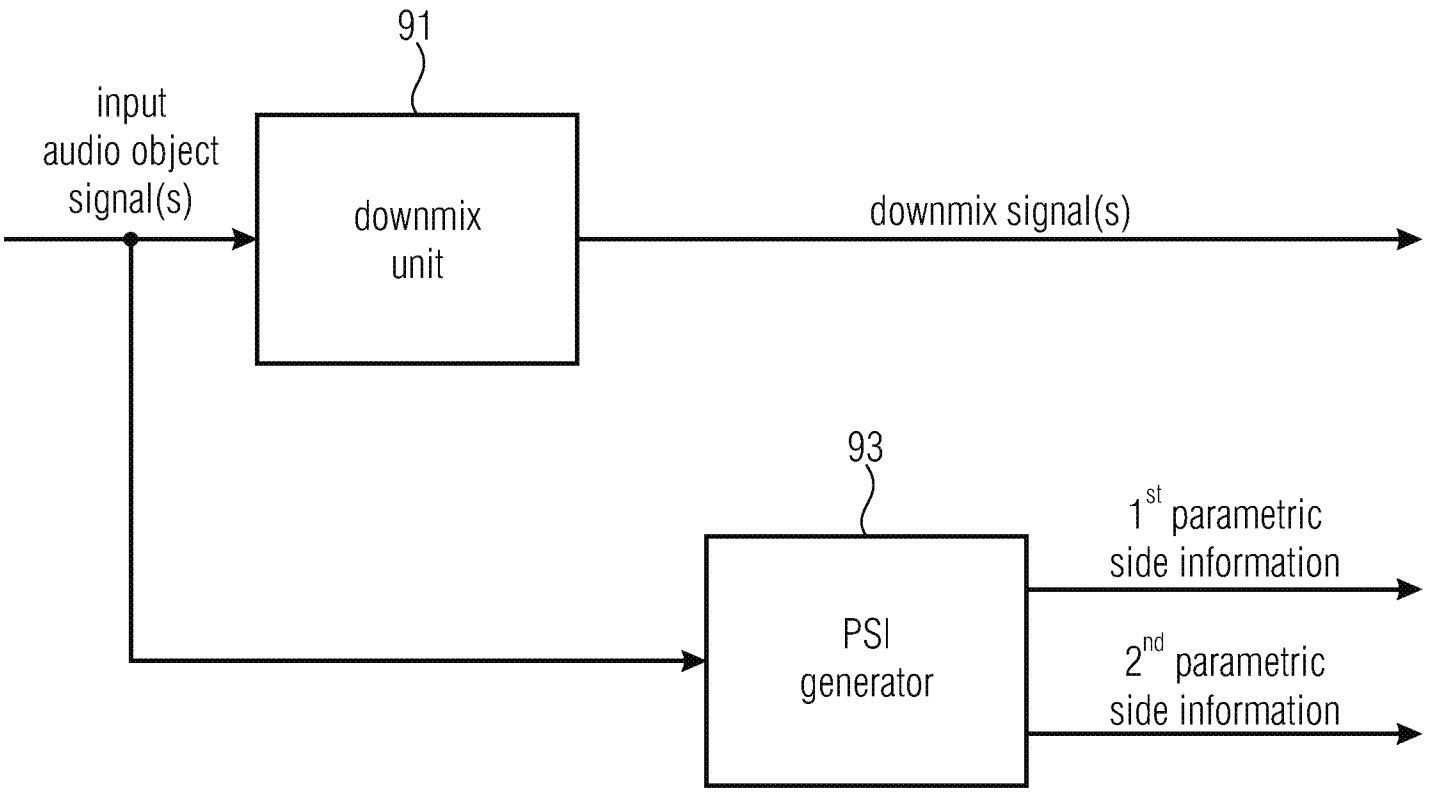
FIG. 2*a* illustrates an encoder according to an embodiment.

FIG. 2*a* illustrates an encoder for encoding one or more input audio object signals according to an embodiment.

The encoder comprises a downmix unit 91 for downmixing the one or more input audio object signals to obtain one or more downmix signals.

Furthermore, the encoder comprises a parametric-side-information generator 93 for generating first parametric side information on the at least one audio object signal and second parametric side information on the at least one audio object signal, such that the frequency resolution of the second parametric side information is higher than the frequency resolution of the first parametric side information.

Figure 2B:
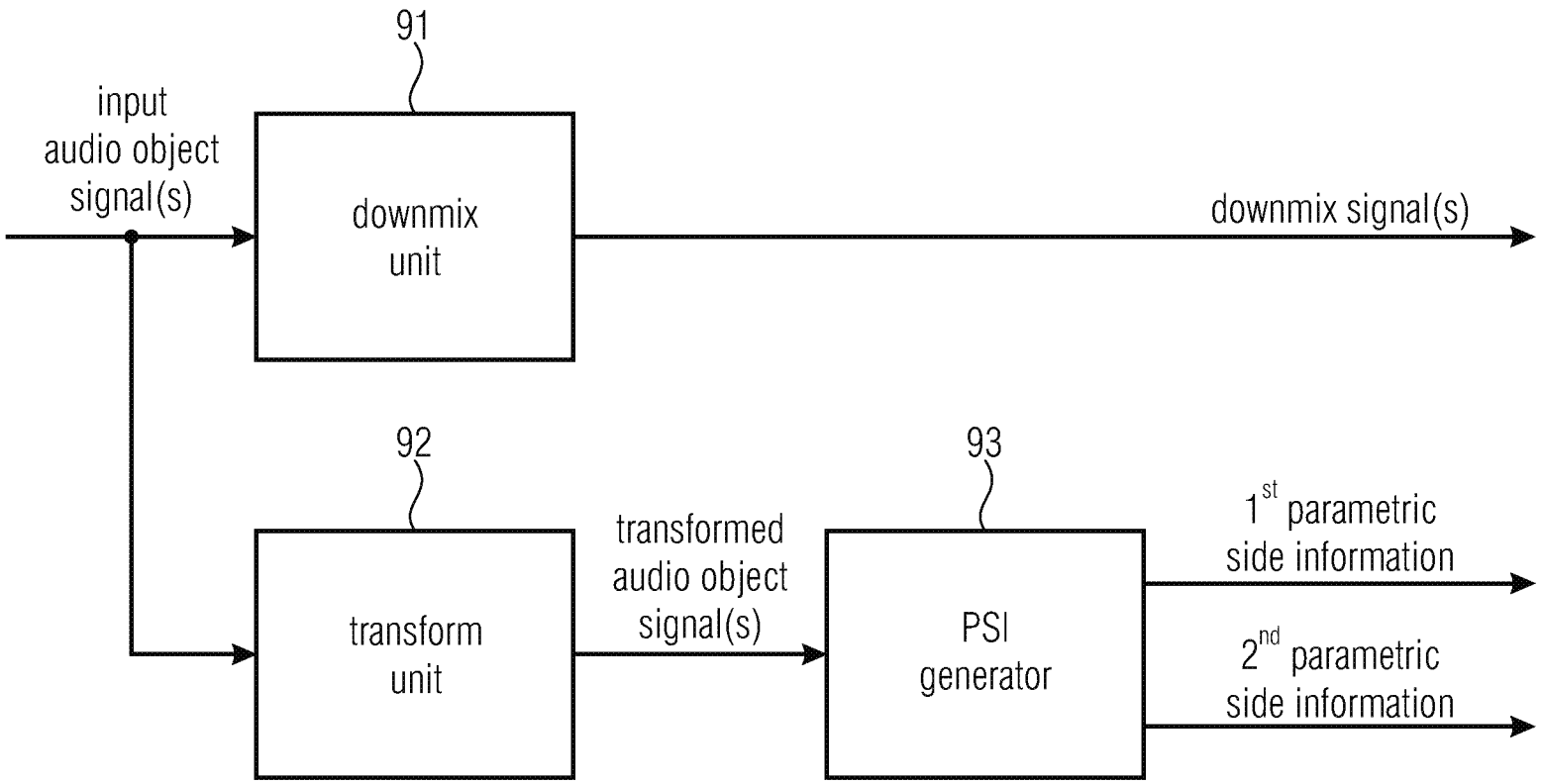
FIG. 2*b* illustrates an encoder according to another embodiment.

FIG. 2*b* illustrates an encoder for encoding one or more input audio object signals according to another embodiment. The encoder of FIG. 2*b* further comprises a transform unit 92 for transforming the one or more input audio object signals from a time domain to a time-frequency domain to obtain one or more transformed audio object signals. In the embodiment of FIG. 2*b*, the parametric-side-information generator 93 is configured to generate the first parametric side information and the second parametric side information based on the one or more transformed audio object signals.

Figure 2C:
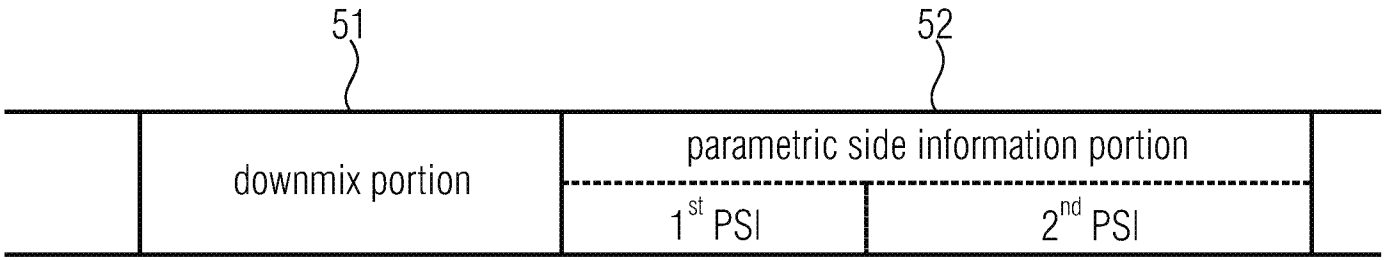
FIG. 2*c* illustrates an encoded audio signal according to an embodiment.

FIG. 2*c* illustrates an encoded audio signal according to an embodiment. The encoded audio signal comprises a downmix portion 51, indicating a downmix of one or more input audio object signals, and a parametric side information portion 52 comprising first parametric side information on the at least one audio object signal and second parametric side information on the at least one audio object signal. The frequency resolution of the second parametric side information is higher than the frequency resolution of the first parametric side information.

Figure 3:
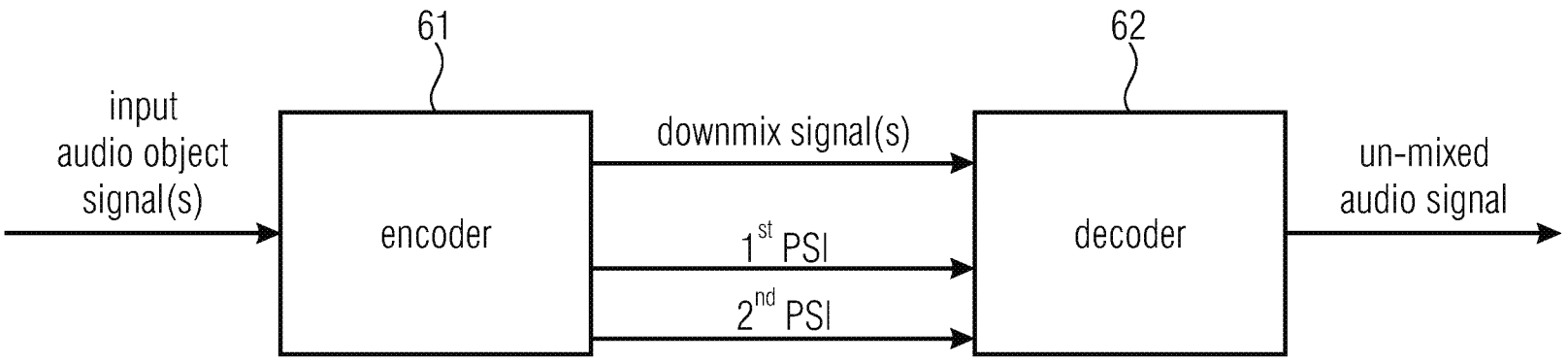
FIG. 3 illustrates a system according to an embodiment.

FIG. 3 illustrates a system according to an embodiment. The system comprises an encoder 61 as described above and a decoder 62 as described above.

The encoder 61 is configured to encode one or more input audio object signals by obtaining one or more downmix signals indicating a downmix of one or more input audio object signals, by obtaining first parametric side information on the at least one audio object signal, and by obtaining second parametric side information on the at least one audio object signal, wherein the frequency resolution of the second parametric side information is higher than the frequency resolution of the first parametric side information.

The decoder 62 is configured to generate an un-mixed audio signal based on the one or more downmix signals, and based on the first parametric side information and the second parametric side information.

In the following, enhanced SAOC using backward compatible frequency resolution improvement is described.

Figure 7:
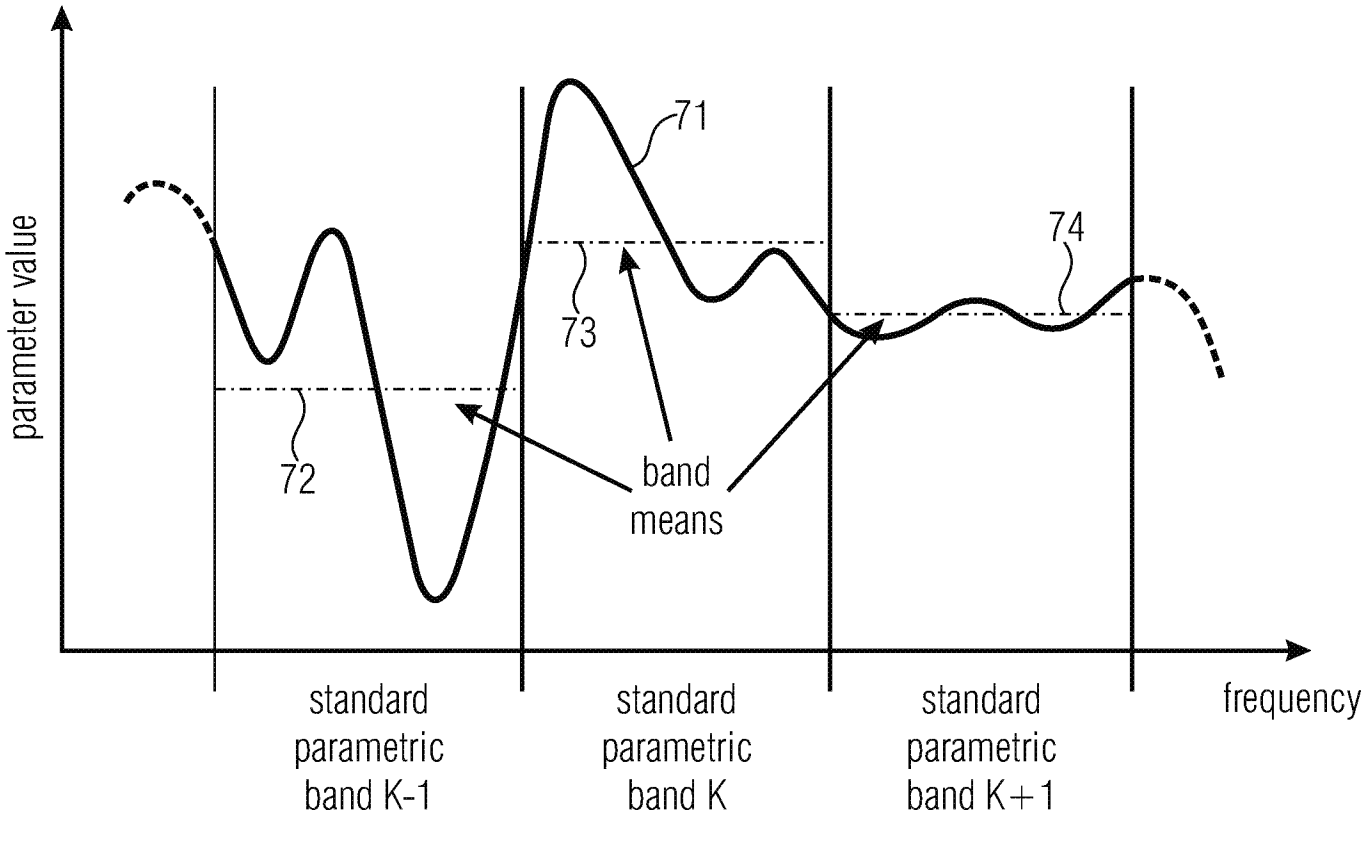
FIG. 7 illustrates backwards compatible representation according to embodiments.

FIG. 7 illustrates backwards compatible representation according to embodiments. The signal property to be represented, e.g., the power spectral envelope 71, varies over the frequency. The frequency axis is partitioned into parametric bands, and a single set of signal descriptors are assigned for each sub-band. Using them instead of delivering the description for each frequency bin separately allows for savings in the amount of the side information necessitated without a significant loss in the perceptual quality. In the standard SAOC, the single descriptor for each band is the mean value 72, 73, 74 of the bin-wise descriptors. As can be understood, this may introduce a loss of information whose magnitude depends on the signal properties. In FIG. 7, the bands k−1 and k have quite a large error, while in the band k+1 the error is much smaller.

Figure 8:
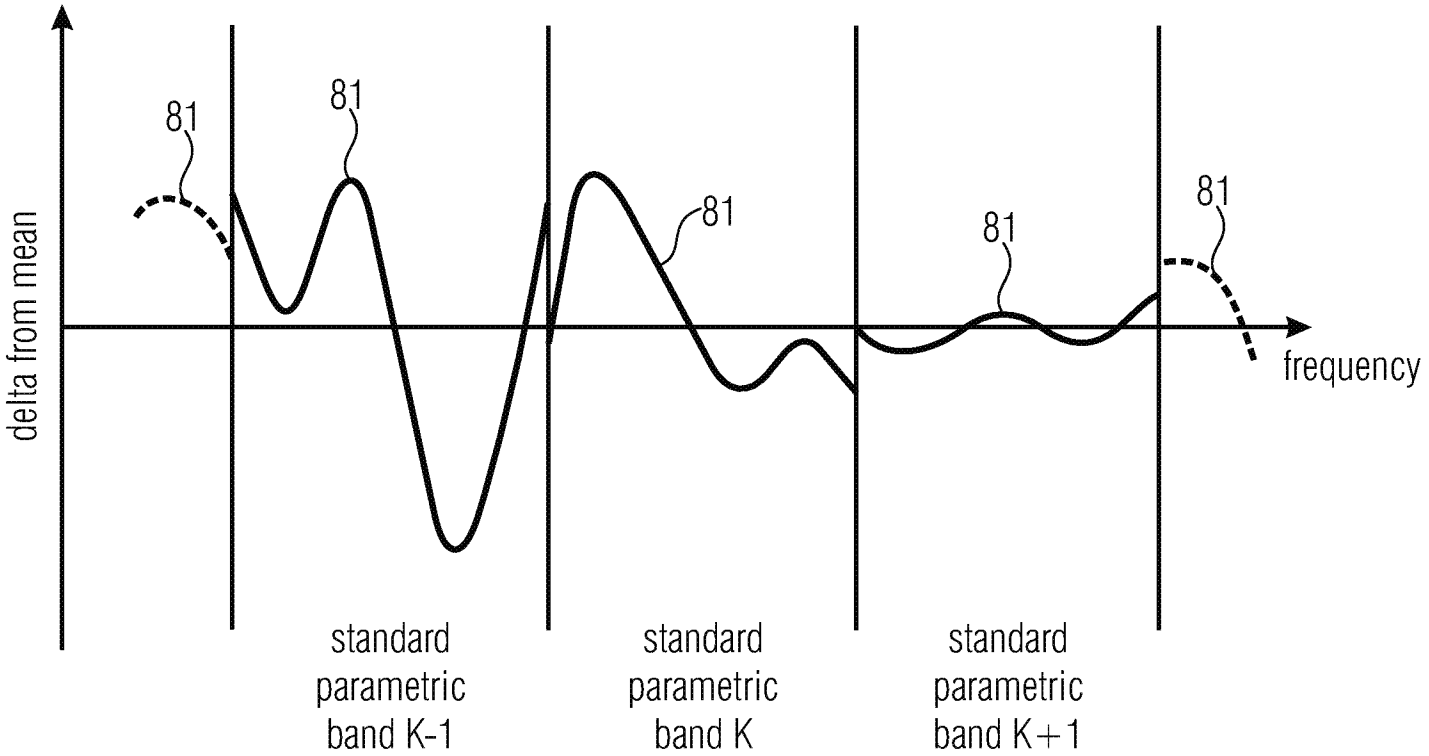
FIG. 8 illustrates the difference curve between the true parameter value and the low-resolution mean value according to an embodiment.

FIG. 8 illustrates the difference curve 81 between the true parameter value and the low-resolution mean value according to an embodiment, e.g., the fine structure information lost in the standard SAOC parameterization. We describe a method for parameterizing and transmitting the difference curves 81 between the mean values 72, 73, 74 (e.g., the standard SAOC descriptor) and the true, fine-resolution values in an efficient manner allowing approximating the fine-resolution structure in the decoder.

It should be noted that adding the enhancement information to a single object in a mixture does not only improve the resulting quality of that specific object, but the quality of all objects sharing the approximate spatial location and having some spectral overlap.

In the following, backward compatible enhanced SAOC encoding with an enhanced encoder is described, in particular, an enhanced SAOC encoder which produces a bit stream containing a backward compatible side information portion and additional enhancements. The added information can be inserted into the standard SAOC bit stream in such a way that the old, standard-compliant decoders simply ignore the added data while the enhanced decoders make use of it. The existing standard SAOC decoders can decode the backward compatible portion of the parametric side information (PSI) and produce reconstructions of the objects, while the added information used by the enhanced SAOC decoder improves the perceptual quality of the reconstructions in most of the cases. Additionally, if the enhanced SAOC decoder is running on limited resources, the enhancements can be ignored and a basic quality reconstruction is still obtained. It should be noted that the reconstructions from standard SAOC and enhanced SAOC decoders using only the standard SAOC compatible PSI differ, but are judged to be perceptually very similar (the difference is of the similar nature as in decoding standard SAOC bit streams with an enhanced SAOC decoder).

Figure 9:
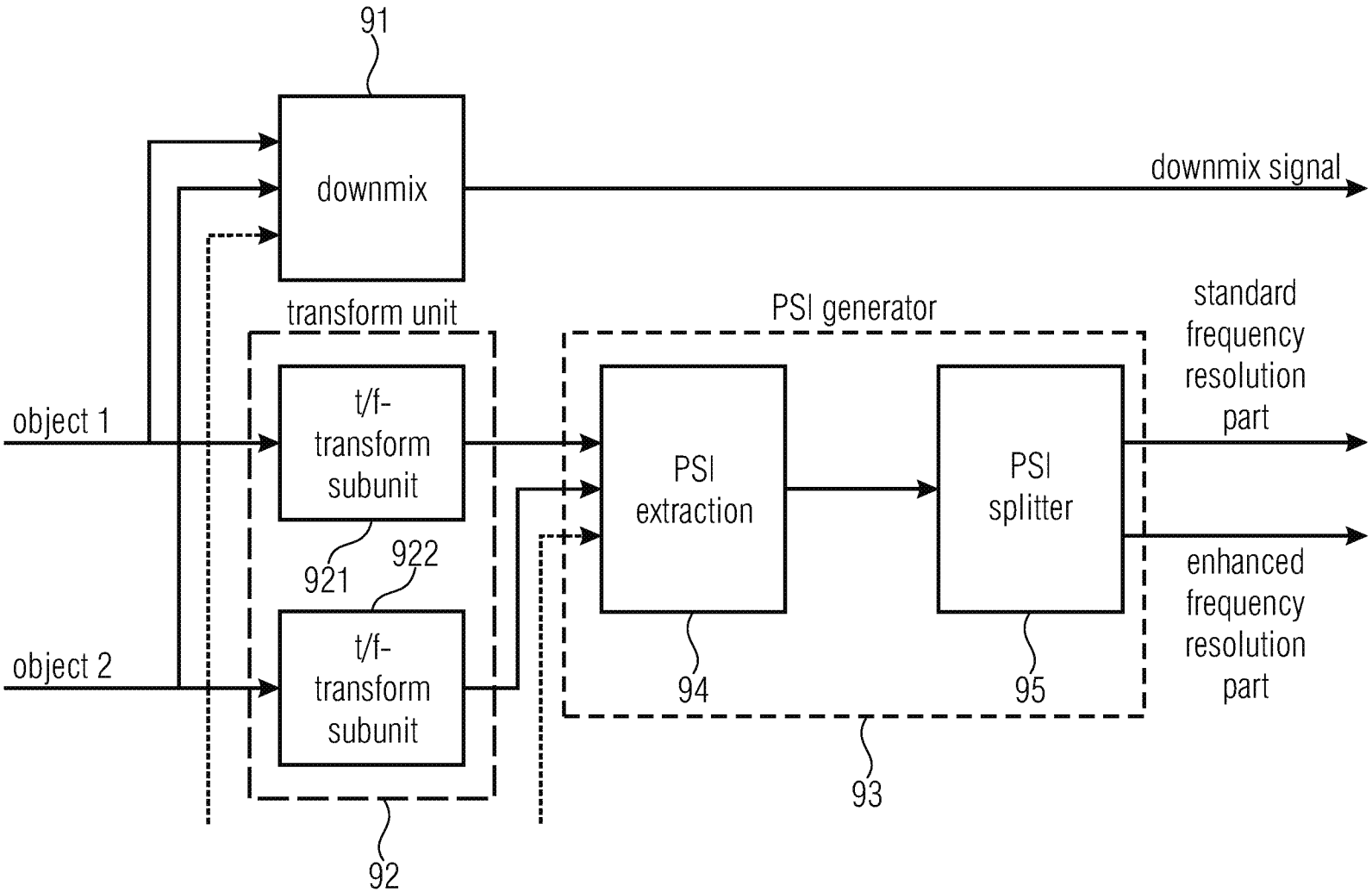
FIG. 9 depicts a high-level illustration of the enhanced encoder providing a backwards compatible bit stream with enhancements according to an embodiment.

FIG. 9 depicts a high-level illustration of the enhanced encoder providing a backwards compatible bit stream with enhancements according to an embodiment.

The encoder comprises a downmix unit 91 for downmixing a plurality of audio object signals to obtain one or more downmix signals. For example, the audio object signals (e.g., the individual (audio) objects) are used by a downmix unit 91 to create a downmix signal. This may happen in time domain, frequency domain, or even an externally provided downmix can be used.

In the PSI-path, the (audio) object signals are transformed by a transform unit 92 from a time domain to a frequency domain, a time-frequency domain or a spectral domain (for example, by a transform unit 92 comprising one or more t/f-transform subunits 921, 922).

Moreover, the encoder comprises a parametric-side-information generator 93 for generating parametric side information. In the embodiment of FIG. 9, the parametric-side-information generator 93, may, for example, comprise a PSI-extraction unit 94 and a PSI splitter 95. According to such an embodiment, in the frequency domain, the PSI is extracted by the PSI-extraction unit 94. The PSI splitter 95 is then conducted to split the PSI into two parts: the standard frequency resolution part that can be decoded with any standard-compliant SAOC-decoder, and the enhanced frequency resolution part. The latter may be "hidden" in bit stream elements, such that these will be ignored by the standard decoders but utilized by the enhanced decoders.

Figure 10:
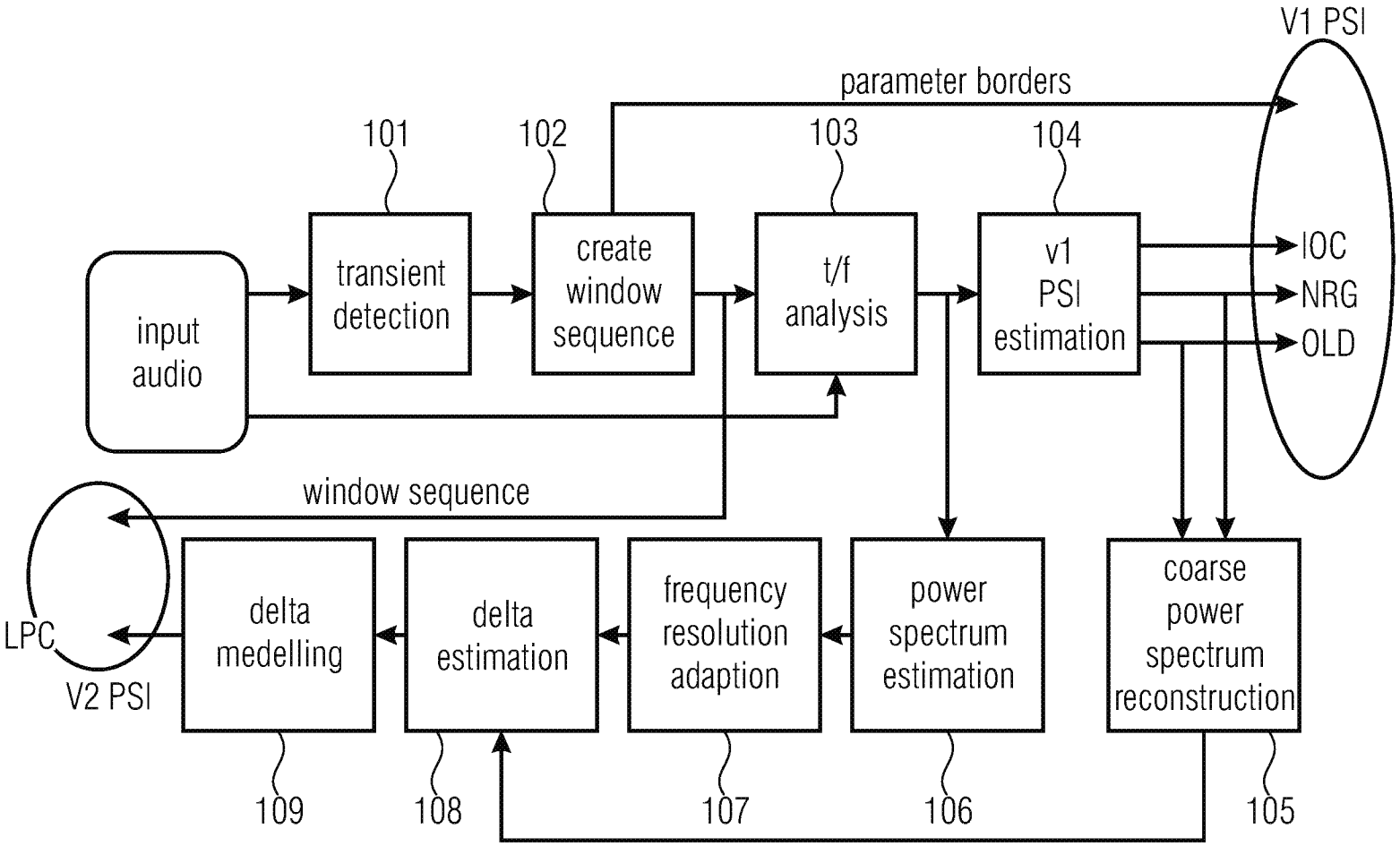
FIG. 10 illustrates a block diagram of an encoder according to a particular embodiment implementing a parametric path of an encoder.

FIG. 10 illustrates a block diagram of an encoder according to a particular embodiment implementing the parametric path of the encoder described above. Bold black functional blocks (102, 105, 106, 107, 108, 109) indicate the main components of the inventive processing. In particular, FIG. 10 illustrates a block diagram of two-stage encoding producing backward-compatible bit stream with enhancements for more capable decoders. The encoder is configured to produce PSI that can be decoded with both decoder versions. The transform unit 92 of FIG. 9 is implemented by a transient-detection unit 101, by a create-window-sequence unit 102, and by a t/f-analysis unit 103 in FIG. 10. The other units 104, 105, 106, 107, 108, 109 in FIG. 10 implement the parametric-side-information generator 93 (e.g. the units 104, 105, 106, 107, 108, 109 may implement the functionality of the combination of the PSI-extraction unit 94 and the PSI splitter 95).

First, the signal is subdivided into analysis frames, which are then transformed into the frequency domain. Multiple analysis frames are grouped into a fixed-length parameter frame, e.g., in standard SAOC lengths of 16 and 32 analysis frames are common. It is assumed that the signal properties remain quasi-stationary during the parameter frame and can thus be characterized with only one set of parameters. If the signal characteristics change within the parameter frame, modeling error is suffered, and it would be beneficial to sub-divide the longer parameter frame into parts in which the assumption of quasi-stationarity is again fulfilled. For this purpose, transient detection is needed.

In an embodiment, the transform unit 92 is configured to transform one or more input audio object signals from the time domain to the time-frequency domain depending on a window length of a signal transform block comprising signal values of at least one of the one or more input audio object signals. The transform unit 92 comprises a transient-detection unit 101 for determining a transient detection result indicating whether a transient is present in one or more of the at least one audio object signals, wherein a transient indicates a signal change in one or more of the at least one audio object signals. Moreover, the transform unit 92 further comprises a window sequence unit 102 for determining the window length depending on the transient detection result.

For example, the transients may be detected by the transient-detection unit 101 from all input objects separately, and when there is a transient event in only one of the objects that location is declared as a global transient location. The information of the transient locations is used for constructing an appropriate windowing sequence. The construction can be based, for example, on the following logic:

- Set a default window length, i.e., the length of a default signal transform block, e.g., 2048 samples.
- Set parameter frame length, e.g., 4096 samples, corresponding to 4 default windows with 50% overlap. Parameter frames group multiple windows together and a single set of signal descriptors are used for the entire block instead of having descriptors for each window separately. This allows reducing the amount of PSI.
- If no transient has been detected, use the default windows and the full parameter frame length.
- If a transient is detected, adapt the windowing to provide a better temporal resolution at the location of the transient.

The create-window-sequence unit 102 constructs the windowing sequence. At the same time, it also creates parameter sub-frames from one or more analysis windows. Each subset is analyzed as an entity and only one set of PSI-parameters are transmitted for each sub-block. To provide a standard SAOC compatible PSI, the defined parameter block length is used as the main parameter block length, and the possible located transients within that block define parameter subsets.

The constructed window sequence is outputted for time-frequency analysis of the input audio signals conducted by the t/f-analysis unit 103, and transmitted in the enhanced SAOC enhancement portion of the PSI.

The PSI consists of sets of object level differences (OLD), inter-object correlations (IOC), and information of the downmix matrix D used to create the downmix signal from the individual objects in the encoder. Each parameter set is associated with a parameter border which defines the temporal region to which the parameters are associated to.

The spectral data of each analysis window is used by the PSI-estimation unit 104 for estimating the PSI for standard SAOC part. This is done by grouping the spectral bins into parametric bands of standard SAOC and estimating the IOCs, OLDs and absolute objects energies (NRG) in the bands. Following loosely the notation of standard SAOC, the normalized product of two object spectra $S_i$ (f,n) and $S_j$(f,n) in a parameterization tile is defined as $$nrg_{i,j}(b) = \frac{\sum_{n=0}^{N-1}\sum_{f=0}^{F_n-1} K(b,f,n)S_i(f,n)S_j^*(f,n)}{\sum_{n=0}^{N-1}\sum_{f=0}^{F_n-1} K(b,f,n)},$$

where the matrix K(b,f,n): $\mathbb{R}^{B\times F_n\times N}$ defines the mapping from the $F_n$ t/f-representation bins in frame n into B parametric bands by $$K(b,f,n) = \begin{cases} 1, & \text{if } f \in b \\ 0, & \text{otherwise} \end{cases}.$$

The spectral resolution can vary between the frames within a single parametric block, so the mapping matrix converts the data into a common resolution basis. The maximum object energy in this parameterization tile is defined to be the maximum object energy $$NRG(b) = \max_i(nrg_{i,i}(b)).$$

Having this value, the OLDs are then defined to be the normalized object energies $$OLD_i(b) = \frac{nrg_{i,i}(b)}{NRG(b)}.$$

And finally the IOC can be obtained from the cross-powers as $$IOC_{i,j}(b) = \mathrm{Re}\left\{\frac{nrg_{i,j}(b)}{\sqrt{nrg_{i,i}(b)nrg_{j,j}(b)}}\right\}.$$

This concludes the estimation of the standard SAOC compatible parts of the bit stream.

A coarse-power-spectrum-reconstruction unit 105 is configured to use the OLDs and NRGs for reconstructing a rough estimate of the spectral envelope in the parameter analysis block. The envelope is constructed in the highest frequency resolution used in that block.

The original spectrum of each analysis window is used by a power-spectrum-estimation unit 106 for calculating the power spectrum in that window.

The obtained power spectra are transformed into a common high frequency resolution representation by a frequency-resolution-adaptation unit 107. This can be done, for example, by interpolating the power spectral values. Then the mean power spectral profile is calculated by averaging the spectra within the parameter block. This corresponds roughly to OLD-estimation omitting the parametric band aggregation. The obtained spectral profile is considered as the fine-resolution OLD.

The encoder further comprises a delta-estimation unit 108 for estimating a plurality of correction factors by dividing each of the plurality of OLDs of one of the at least one audio object signal by a value of a power spectrum reconstruction of said one of the at least one audio object signal to obtain the second parametric side information, wherein said plurality of OLDs has a higher frequency resolution than said power spectrum reconstruction.

In an embodiment, the delta-estimation unit 108 is configured to estimate a plurality of correction factors based on a plurality of parametric values depending on the at least one audio object signal to obtain the second parametric side information. E.g., the delta-estimation unit 108 may be configured to estimate a correction factor, "delta", for example, by dividing the fine-resolution OLD by the rough power spectrum reconstruction. As a result, this provides for each frequency bin a (for example, multiplicative) correction factor that can be used for approximating the fine-resolution OLD given the rough spectra.

Finally, a delta-modeling unit 109 is configured to model the estimated correction factor in an efficient way for transmission. One possibility for modeling using Linear Prediction Coefficients (LPC) is described later below.

Effectively, the enhanced SAOC modifications consist of adding the windowing sequence information and the parameters for transmitting the "delta" to the bit stream.

In the following, an enhanced decoder is described.

Figure 11:
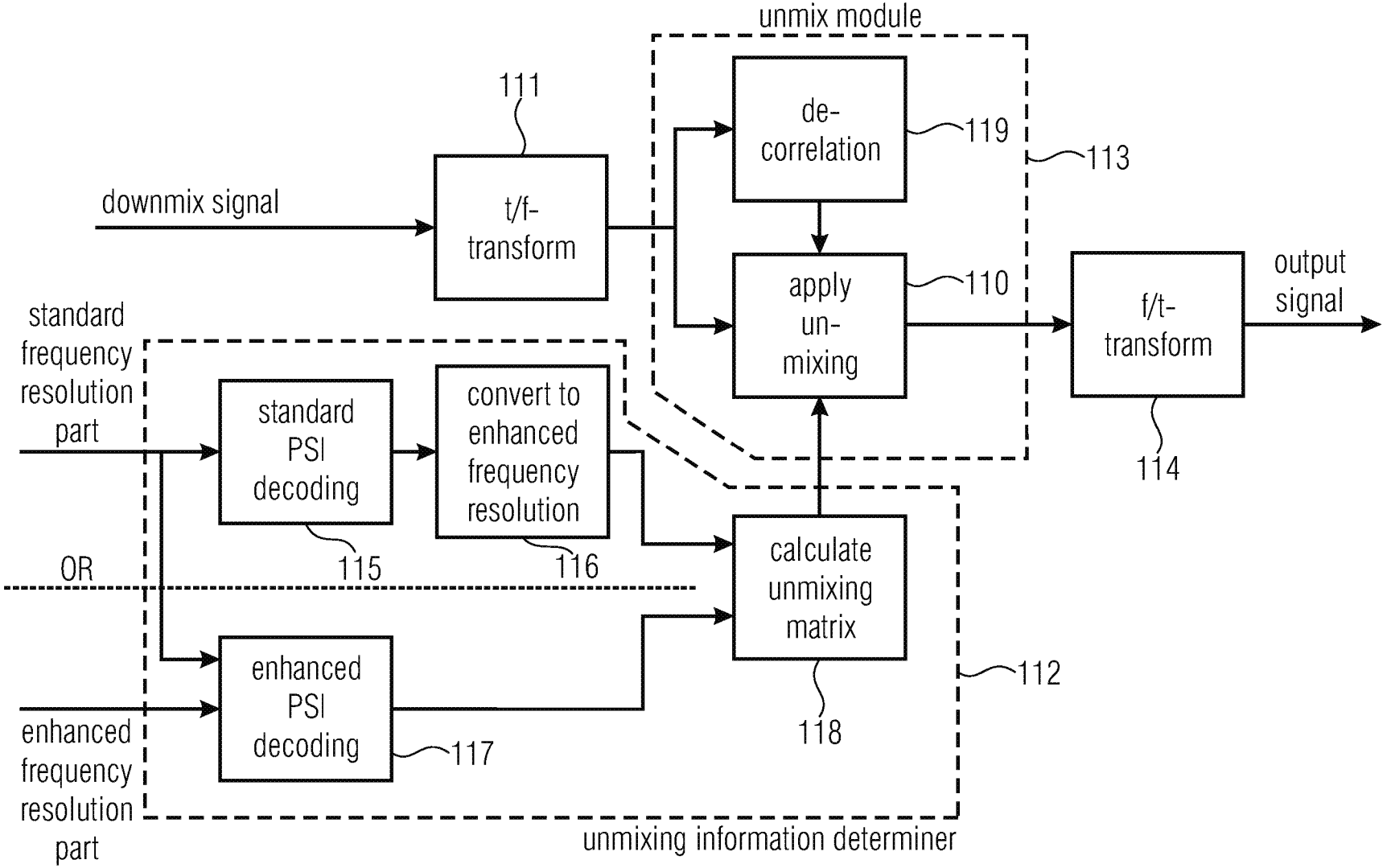
FIG. 11 depicts a high-level block diagram of an enhanced decoder according to an embodiment which is capable of decoding both standard and enhanced bit streams.

FIG. 11 depicts a high-level block diagram of an enhanced decoder according to an embodiment which is capable of decoding both standard and enhanced bit streams. In particular, FIG. 11 illustrates an operational block diagram of an enhanced decoder capable of decoding both standard bit streams as well as bit streams including frequency resolution enhancements.

The input downmix signal is transformed into frequency domain by a t/f-transform unit 111.

The estimated un-mixing matrix is applied on the transformed downmix signal by an un-mixing unit 110 to generate an un-mixing output.

Additionally, a decorrelation path is included to allow a better spatial control of the objects in the un-mixing. A decorrelation unit 119 conducts decorrelation on the transformed downmix signal and the result of the decorrelation is fed into the un-mixing unit 110. The un-mixing unit 110 uses the decorrelation result for generating the un-mixing output.

The un-mixing output is then transformed back into the time domain by a fit-transform unit 114.

The parametric processing path can take standard resolution PSI as the input, in which case the decoded PSI, which is generated by a standard-PSI-decoding unit 115, is adapted by a frequency-resolution-conversion unit 116 to the frequency resolution used in the t/f-transforms.

An alternative input combines the standard frequency resolution part of the PSI with the enhanced frequency resolution part and the calculations include the enhanced frequency resolution information. In more detail, an enhanced PSI-decoding unit 117 generates decoded PSI exhibiting enhanced frequency resolution.

An un-mixing-matrix generator 118 generates an un-mixing matrix based on the decoded PSI received from the frequency-resolution-conversion unit 116 or from the enhanced PSI-decoding unit 117. The un-mixing-matrix generator 118 may also generate the un-mixing matrix based on rendering information, for example, based on a rendering matrix. The un-mixing unit 110 is configured to generate the un-mixing output by applying this un-mixing matrix, being generated by the un-mixing-matrix generator 118, on the transformed downmix signal.

Figure 12:
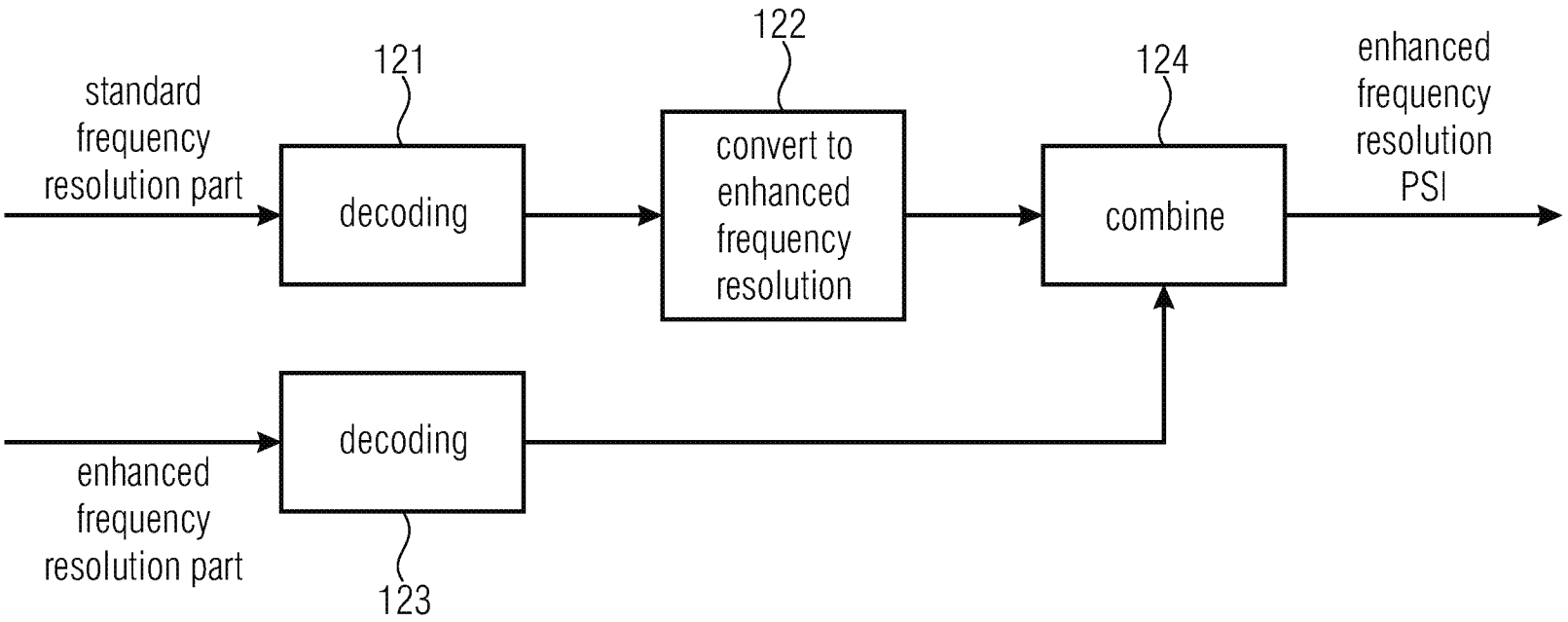
FIG. 12 illustrates a block diagram illustrating an embodiment of the enhanced PSI-decoding unit.

FIG. 12 illustrates a block diagram illustrating an embodiment of the enhanced PSI-decoding unit 117 of FIG. 11.

The first parametric information comprises a plurality of first parameter values, wherein the second parametric information comprises a plurality of second parameter values. The un-mixing-information determiner 112 comprises a frequency-resolution-conversion subunit 122 and a combiner 124. The frequency-resolution-conversion unit 112 is configured to generate additional parameter values, e.g., by replicating the first parameter values, wherein the first parameter values and the additional parameter values together form a plurality of first processed parameter values. The combiner 124 is configured to combine the first processed parameter values and the second parameter values to obtain a plurality of modified parameter values as the modified parametric information.

According to an embodiment, the standard frequency resolution part is decoded by a decoding subunit 121 and converted by a frequency-resolution-conversion subunit 122 into the frequency resolution used by the enhancement part. The decoded enhancement part, generated by an enhanced PSI-decoding subunit 123, is combined by a combiner 124 with the converted standard-resolution part.

In the following, the two decoding modes with possible implementations are described in more detail.

At first, decoding of standard SAOC bit streams with an enhanced decoder is described:

The enhanced SAOC decoder is designed so that it is capable decoding bit streams from standard SAOC encoders with a good quality. The decoding is limited to the parametric reconstruction only, and possible residual streams are ignored.

Figure 13:
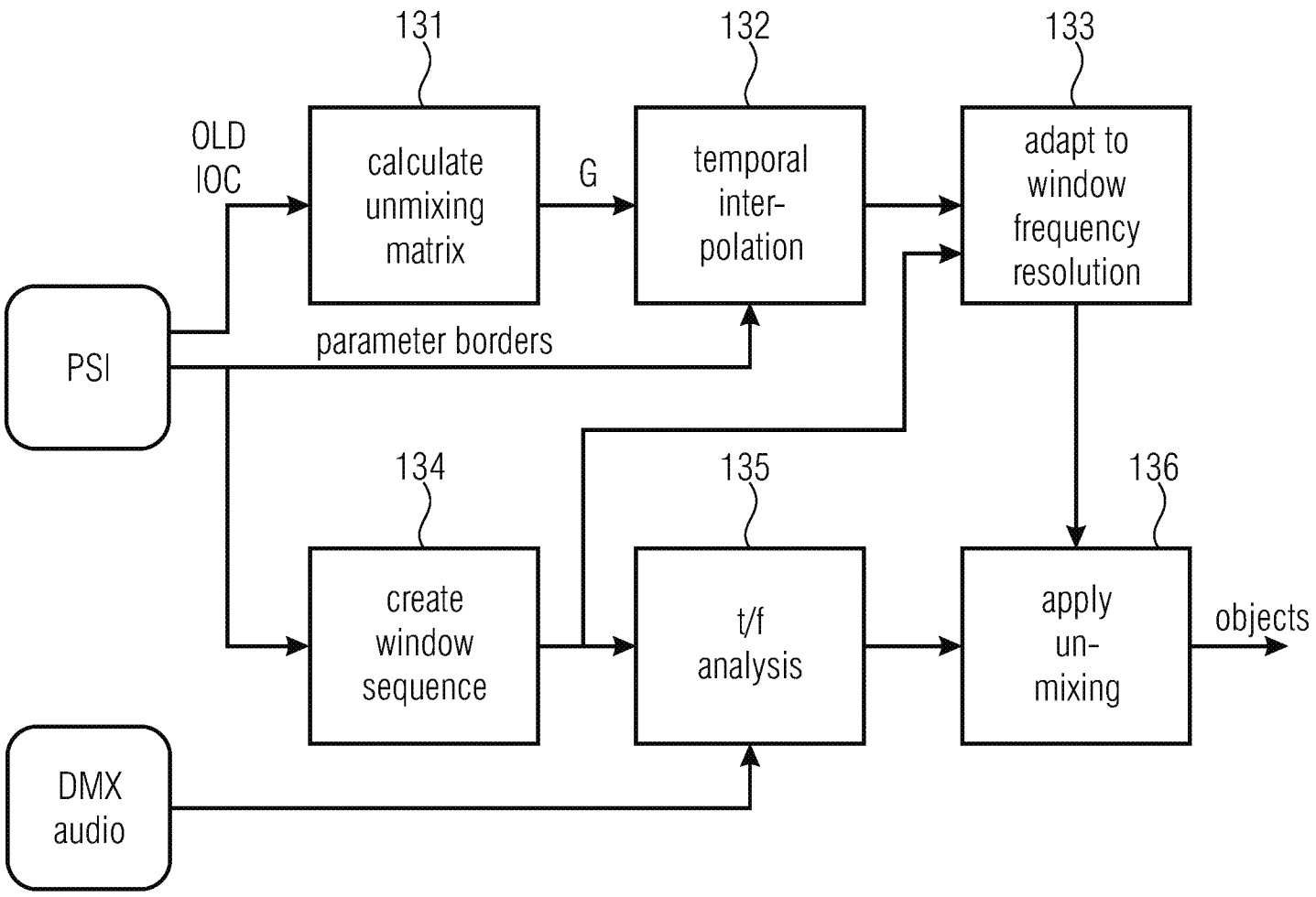
FIG. 13 depicts a block diagram of decoding standard SAOC bit streams with the enhanced SAOC decoder according to an embodiment.

FIG. 13 depicts a block diagram of decoding standard SAOC bit streams with the enhanced SAOC decoder illustrating the decoding process according to an embodiment. Bold black functional blocks (131, 132, 133, 135) indicate the main part of the inventive processing.

An un-mixing-matrix calculator 131, a temporal interpolator 132, and a window-frequency-resolution-adaptation unit 133 implement the functionality of the standard-PSI-decoding unit 115, of the frequency-resolution-conversion unit 116, and of the un-mixing-matrix generator 118 of FIG. 11. A window-sequence generator 134 and a t/f-analysis module 135 implement the t/f-transform unit 111 of FIG. 11.

Normally, the frequency bins of the underlying time/frequency-representation are grouped into parametric bands. The spacing of the bands resembles that of the critical bands in the human auditory system. Furthermore, multiple t/f-representation frames can be grouped into a parameter frame. Both of these operations provide a reduction in the amount of necessitated side information with the cost of modeling inaccuracies.

As described in the SAOC standard, the OLDs and IOCs are used to calculate the un-mixing matrix G=ED*J, where the elements of E are defined as $E(i,j)=IOC_{i,j}\sqrt{OLD_i OLD_j}$ approximates the object cross-correlation matrix, i and j are object indices, $J\approx(DED^*)^{-1}$. The un-mixing-matrix calculator 131 may be conducted to calculate the un-mixing matrix.

The un-mixing matrix is then linearly interpolated by the temporal interpolator 132 from the un-mixing matrix of the preceding frame over the parameter frame up to the parameter border on which the estimated values are reached, as per standard SAOC. This results into un-mixing matrices for each time-/frequency-analysis window and parametric band.

The parametric band frequency resolution of the un-mixing matrices is expanded to the resolution of the time/frequency-representation in that analysis window by the window-frequency-resolution-adaptation unit 133. When the interpolated un-mixing matrix for parametric band b in a time-frame is defined as G(b), the same un-mixing coefficients are used for all the frequency bins inside that parametric band.

The window-sequence generator 134 is configured to use the parameter set range information from the PSI to determine an appropriate windowing sequence for analyzing the input downmix audio signal. The main requirement is that when there is a parameter set border in the PSI, the cross-over point between consecutive analysis windows should match it. The windowing determines also the frequency resolution of the data within each window (used in the un-mixing data expansion, as described earlier).

The windowed data is then transformed by the t/f-analysis module 135 into a frequency domain representation using an appropriate time-frequency transform, e.g., Discrete Fourier Transform (DFT), Complex Modified Discrete Cosine Transform (CMDCT), or Oddly stacked Discrete Fourier Transform (ODFT).

Finally, an un-mixing unit 136 applies the per-frame per-frequency bin un-mixing matrices on the spectral representation of the downmix signal X to obtain the parametric renderings Y. The output channel j is a linear combination of the downmix channels $$Y_j = \sum_i G_{j,i} X_i.$$

The quality that can be obtained with this process is for most of the purposes perceptually indistinguishable from the result obtained with a standard SAOC decoder.

It should be noted that the above text describes reconstruction of individual objects, but in standard SAOC the rendering is included in the un-mixing matrix, i.e., it is included in parametric interpolation. As a linear operation, the order of the operations does not matter, but the difference is worth noting.

In the following, decoding of enhanced SAOC bit streams with an enhanced decoder is described.

The main functionality of the enhanced SAOC decoder is already described earlier in decoding of standard SAOC bit streams. This section will detail how the introduced enhanced SAOC enhancements in the PSI can be used for obtaining a better perceptual quality.

Figure 14:
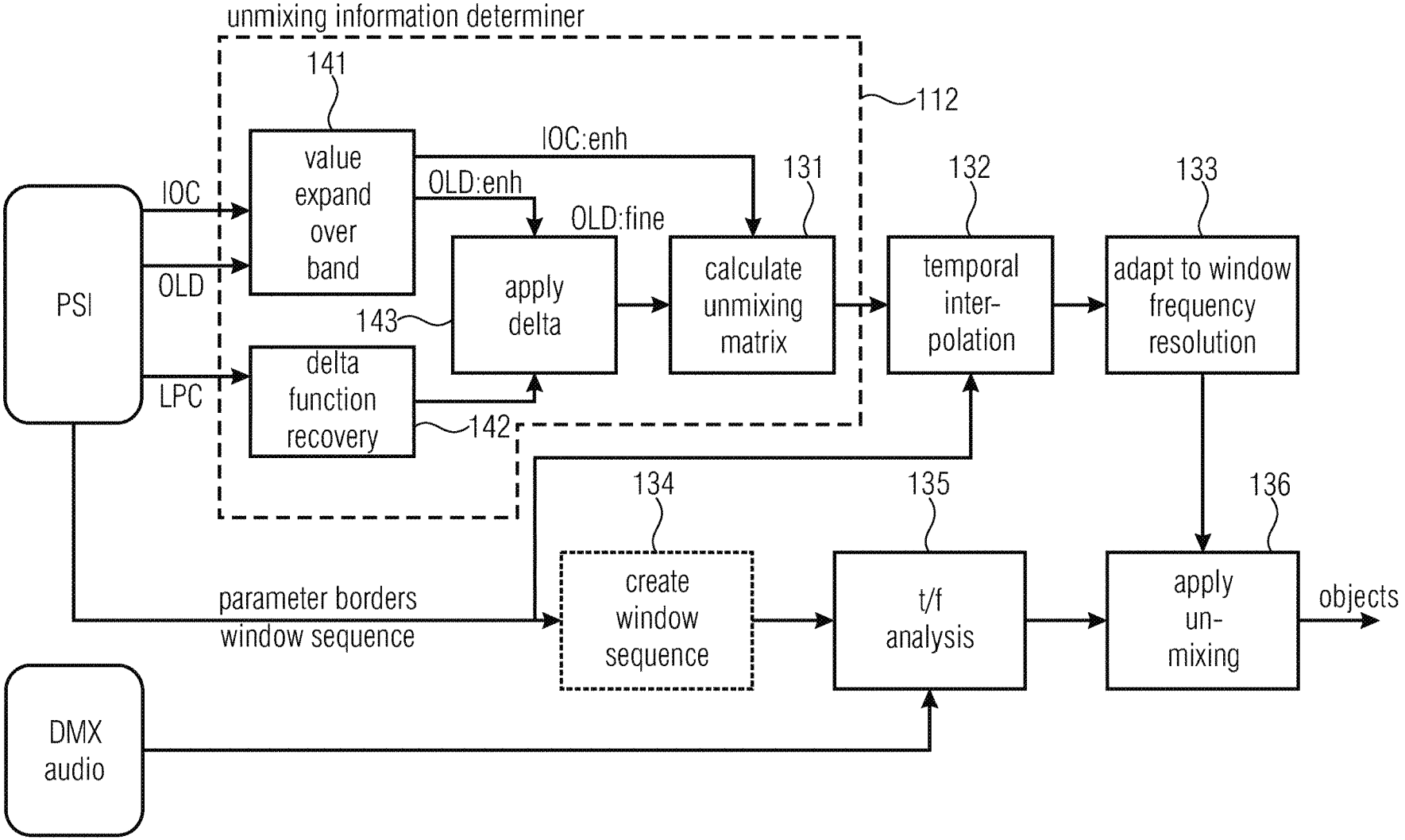
FIG. 14 depicts the main functional blocks of the decoder according to an embodiment.

FIG. 14 depicts the main functional blocks of the decoder according to an embodiment illustrating the decoding of the frequency resolution enhancements. Bold black functional blocks (141, 142, 143) indicate the main part of the inventive processing. A value-expand-over-band unit 141, a delta-function-recovery unit 142, a delta-application unit 143, an un-mixing-matrix calculator 131, a temporal interpolator 132, and a window-frequency-resolution-adaptation unit 133 implement the functionality of the enhanced PSI-decoding unit 117 and of the un-mixing-matrix generator 118 of FIG. 11.

The decoder of FIG. 14 comprises an un-mixing-information determiner 112. Inter alia, the un-mixing-information determiner 112 comprises the delta-function-recovery unit 142 and the delta-application unit 143. The first parametric information comprises a plurality of parametric values depending on the at least one audio object signal, for example, object level difference values. The second parametric information comprises a correction factor parameterization. The delta-function-recovery unit 142 is configured to invert the correction factor parameterization to obtain a delta function. The delta-application unit 143 is configured to apply the delta function on the parametric values, e.g., on the object level difference values, to determine the un-mixing information. In an embodiment, the correction factor parameterization comprises a plurality of linear prediction coefficients, and the delta-function-recovery unit 142 is configured to invert the correction factor parameterization by generating a plurality of correction factors depending on the plurality of linear prediction coefficients, and is configured to generate the delta function based on the plurality of correction factors.

For example, at first, the value-expand-over-band unit 141 adapts the OLD and IOC values for each parametric band to the frequency resolution used in the enhancements, e.g., to 1024 bins. This is done by replicating the value over the frequency bins that correspond to the parametric band. This results into new OLDs $OLD_i^{enh}(f)=K(f,b)OLD_i(b)$ and IOCs $IOC_{i,j}^{enh}(f)=K(f,b)IOC_{i,j}(b)$. K(f,b) is a kernel matrix defining the assignment of frequency bins f into parametric bands b.

Parallel to this, the delta-function-recovery unit 142 inverts the correction factor parameterization to obtain the delta function $C_i^{rec}(f)$ of the same size as the expanded OLD and IOC.

Then, the delta-application unit 143 applies the delta on the expanded OLD values, and the obtained fine resolution OLD values are obtained by $OLD_i^{fine}(f)=C_i^{rec}(f)OLD_i^{enh}(f)$.

In a particular embodiment, the calculation of un-mixing matrices, may, for example, be done by the un-mixing-matrix calculator 131 as with decoding standard SAOC bit stream: $G(f)=E(f)D^*(f)J(f)$, with $E_{i,j}(f)=IOC_{i,j}^{enh}(f)\sqrt{OLD_i^{fine}(f)OLD_j^{fine}(f)}$, and $J(f)\approx(D(f)E(f)D^*(f))^{-1}$. If wanted, the rendering matrix can be multiplied into the un-mixing matrix G(f). The temporal interpolation by the temporal interpolator 132 follows as per the standard SAOC.

As the frequency resolution in each window may be different (lower) from the nominal high frequency resolution, the window-frequency-resolution-adaptation unit 133 need to adapt the un-mixing matrices to match the resolution of the spectral data from audio to allow applying it. This can be made, e.g., by re-sampling the coefficients over the frequency axis to the correct resolution. Or if the resolutions are integer multiples, simply averaging from the high-resolution data the indices that correspond to one frequency bin in the lower resolution $$G^{low}(b) = 1/\|b\| \sum_{f \in b} G(f).$$

The windowing sequence information from the bit stream can be used to obtain a fully complementary time-frequency analysis to the one used in the encoder, or the windowing sequence can be constructed based on the parameter borders, as is done in the standard SAOC bit stream decoding. For this, a window-sequence generator 134 may be employed.

The time-frequency analysis of the downmix audio is then conducted by a t/f-analysis module 135 using the given windows.

Finally, the temporally interpolated and spectrally (possibly) adapted un-mixing matrices are applied by an un-mixing unit 136 on the time-frequency representation of the input audio, and the output channel j can be obtained as a linear combination of the input channels $$Y_j(f) = \sum_i G_{j,i}^{low}(f) X_i(f).$$

In the following, particular aspects of embodiments are described.

In an embodiment, the delta-modeling unit 109 of FIG. 10 is configured to determine linear prediction coefficients from a plurality of correction factors (delta) by conducting a linear prediction.

Now, the estimation process of the correction factor, delta, and a possible modeling alternative using linear prediction coefficients (LPC) according to such an embodiment is described.

At first, delta estimation according to an embodiment is described.

The input to the estimation consists of the estimated fine-resolution power spectral profiles over the parameter block and from the coarse reconstruction of the power spectral profile based on the OLD and NRG parameters. The fine power spectrum profiles are calculated in the following manner. $S_i(f, n)$ is the complex spectrum of the i th object with f being the frequency bin index and $0 \le n \le N-1$ being the temporal window index in the modeling block of the length N. The fine-resolution power spectrum is then $$P_i(f) = \frac{1}{N} \sum_{n=0}^{N-1} S_i(f, n) S_i^*(f, n).$$

The coarse reconstruction is calculated from the (dequantized) OLDs and NRGs by $Z_i(f)=K(f,b)OLD_i(b)NRG_i(b)$, where K(f, b) is the kernel matrix defining the assignment of frequency bins f into parametric bands b.

Two signals with differing spectral properties will be used as examples in this section: the first one is (pink) noise with practically flat spectrum (ignoring the spectral tilt), and the second is a tone from the instrument glockenspiel which has a highly tonal, i.e., peaky, spectrum.

Figure 15:
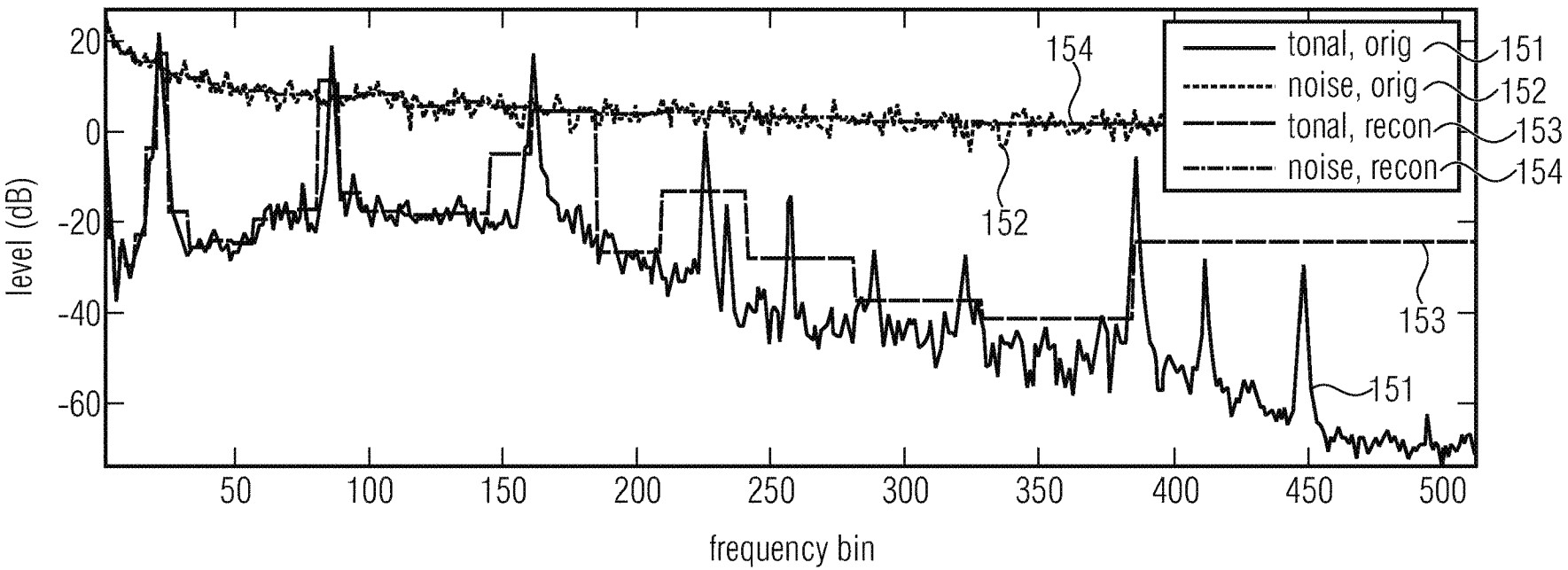
FIG. 15 illustrates a tonal and a noise signal and, in particular, high-resolution power spectra and the corresponding rough reconstructions.

FIG. 15 illustrates the power spectra of a tonal and a noise signal. Their high-resolution power spectra ("orig") and the corresponding rough reconstructions based on OLDs and NRG ("recon"). In particular, FIG. 15 illustrates the fine and coarse power spectra of both of the signals. More particularly, the power spectra of an original tonal signal 151 and an original noise signal 152, and the reconstructed power spectra of the tonal signal 153 and the noise signal 154 are shown. It should be noted that, in the following figures, for signals 153 and 154 rather the scale factors (reconstructed power spectra parameter) and not the fully reconstructed signals are sketched.

It can be quickly noticed, the average difference between the fine and coarse value are rather small in the case of the noise signal, while the differences are very large in the tonal signal. These differences cause perceptual degradations in the parametric reconstruction of all objects.

The correction factor is obtained by dividing the fine-resolution curve by the coarse reconstruction curve:

$$C_i(f)=P_i(f)/Z_i(f).$$

This allows recovering a multiplicative factor that can be applied on the rough reconstruction to obtain the fine-resolution curve:

$$P_i^{rec}(f)=Z_i(f)C_i(f).$$

Figure 16:
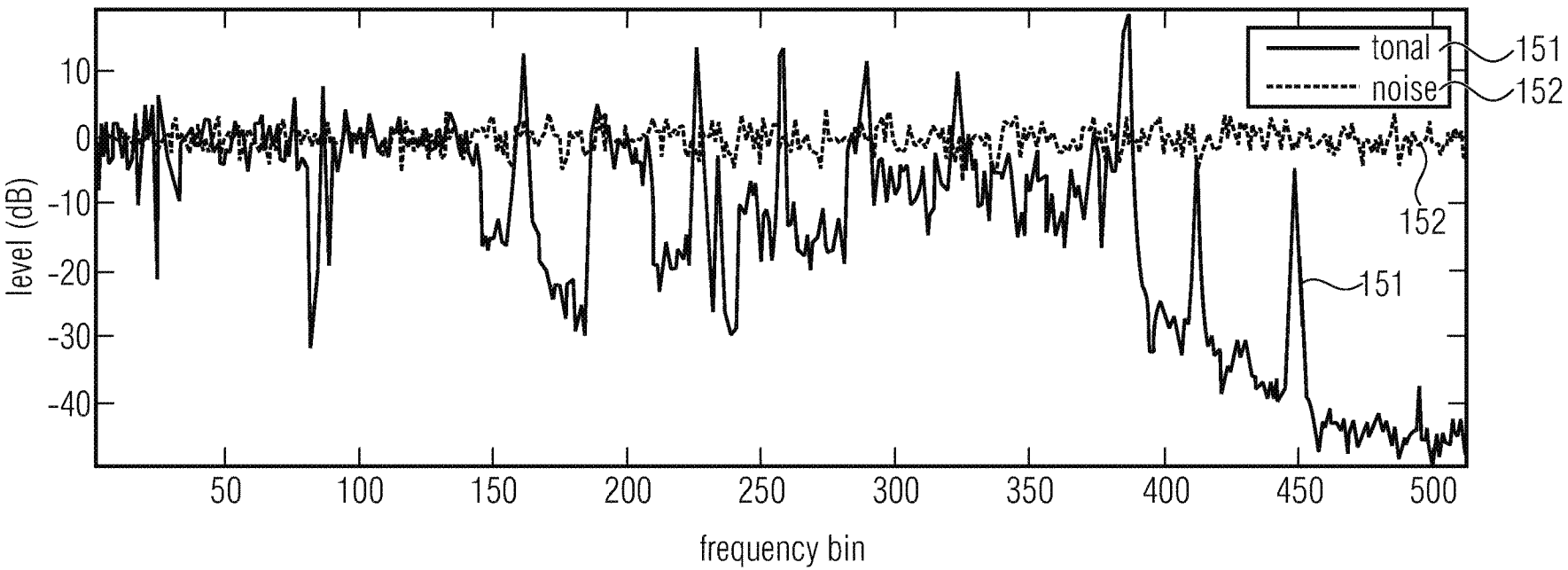
FIG. 16 illustrates the modification for both example signals, in particular the correction factors for the example signals.

FIG. 16 illustrates the modification for both example signals, in particular the correction factors for the example signals. In particular, the correction factors for the tonal signal 151 and the noise signal 152 are shown.

In the following, delta modeling is described.

The correction curve C is assigned into one or more modeling blocks over the frequency axis. A natural alternative is to use the same parameter band definitions as are used for the standard SAOC PSI. The modeling is then done for each block separately with the following steps:

1. The spectral correction factor C is transformed to time domain autocorrelation sequence with Inverse Discrete Fourier Transform (IDFT).

When the length of the modeling block is odd, the pseudo-spectrum to be transformed is defined as $$R(l) = \begin{cases} C(l), \text{ when } 0 \le l \le N-1 \\ C(2N-2-l), \text{ when } N \le l \le 2N-3 \end{cases}.$$

When the modeling block is even, the pseudo-spectrum is defined as $$R(l) = \begin{cases} C(l), \text{ when } 0 \le l \le N-1 \\ C(2N-1-l), \text{ when } N \le l \le 2N-2 \end{cases}.$$

The transform result is then r(t)=IDFT(R(l)).

$$\begin{cases} 0 \le t \le N-2, \text{ when } N \text{ is odd} \\ 0 \le t \le N-1, \text{ when } N \text{ is even} \end{cases}$$

2. The result is truncated into the first half:
3. Levinson-Durbin recursions are applied on the autocorrelation sequence r(t) to get the reflection coefficients k and modeling residual variances e for increasing model orders.
4. Optional: Based on modeling residual variance e, omit the entire modeling (as no gain was obtained) or select an appropriate order.
5. The model parameters are quantized for transmission.

It is possible to make a decision if the delta should be transmitted for each t-f tile (standard parametric band defining the frequency range and the parameter block the temporal range) independently. The decision can be made based on, for example, Inspecting the delta modeling residual energy. If the modeling residual energy does not exceed a certain threshold, the enhancement information is not transmitted.

Measuring the "spikiness"/un-flatness of the fine-resolution modeled parametric description, the delta modeling, or the power spectral envelope of the audio object signal. Depending on the measured value the delta modeling parameters, which describe the fine spectral resolution, are transmitted or not, or computed at all dependent on the un-flatness of the power spectral envelope of the audio object signal). Appropriate measures are for example the spectral crest factor, the spectral flatness measure, or the minimum-maximum ratio.

The perceptual quality of the reconstruction obtained. The encoder calculates the rendering reconstructions with and without the enhancements, and determines the quality gain for each enhancement. Then the point of appropriate balance between the modeling complexity and the quality gain is located, and the indicated enhancements are transmitted. For example, a perceptually weighted distortion to signal-ratio or enhanced perceptual measures can be used for the decision. The decision can be made for each (coarse) parametric band separately (i.e., local quality optimization), but also under consideration of adjacent bands to account for signal distortions caused by time- and frequency-variant manipulation of the time-frequency coefficients (i.e., global quality optimization).

Now, delta reconstruction and application is described.

The reconstruction of the correction curve follows the steps:

1. The received reflection coefficients k (a vector of the length L−1) are de-quantized and transformed into IIR-filter coefficients a of the length L, in pseudo code syntax (where the function X=diag(x) outputs a matrix X with the diagonal elements of X being x and all non-diagonal elements of X being zero):

```
A = diag(k)
for ii=1 to L
    for l=1 to ii−1
        A(l,ii) = A(l,ii−1) + k(ii)*A(ii−l,ii−1)
    end
end
a = [1; A(1 to end,end)]
```

2. The frequency response h(n) of the resulting filter a is calculated with $$h(n) = 1 \Big/ \sum_{l=0}^{L-1} a(l)\exp(-in2\pi/N),$$

where i denotes the imaginary unit $i=\sqrt{-1}$.

3. The correction function reconstruction is obtained from this by $C^{raw}(n)=h(n)h^*(n)$.

4. The response is normalized to have a unity mean, so that the overall energy of the modeled block does not change $$C^{rec}(n) = C^{raw}(n) \Big/ \sum_{n=0}^{N-1} C^{raw}(n).$$

5. The correction factors are applied on OLDs, that have been extended to the fine resolution $OLD_i^{fine}(f)=C_i^{rec}(f)K(f,b)OLD_i(b)$. Note, that in the absolute energies can be ignored as they would be cancelled in the further calculations.

Figure 17:
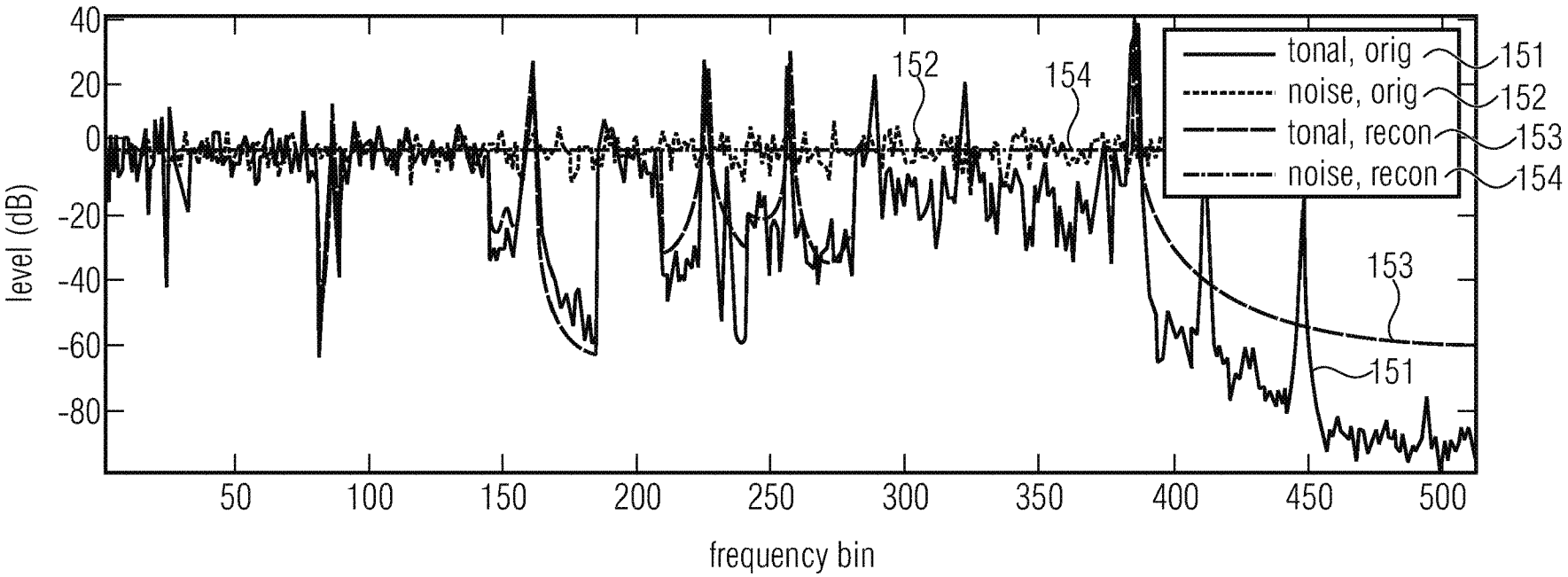
FIG. 17 illustrates the original correction factors and the reduced-order linear prediction based approximations for both of the example signals.

FIG. 17 illustrates the original correction factors and the reduced-order LPC-based approximations (after the modeling) for both of the example signals. In particular, the original correction factors of the tonal signal 151, the original noise signal 152, and the reconstructed correction factor estimates of the tonal signal 153 and the noise signal 154 are shown.

Figure 18:
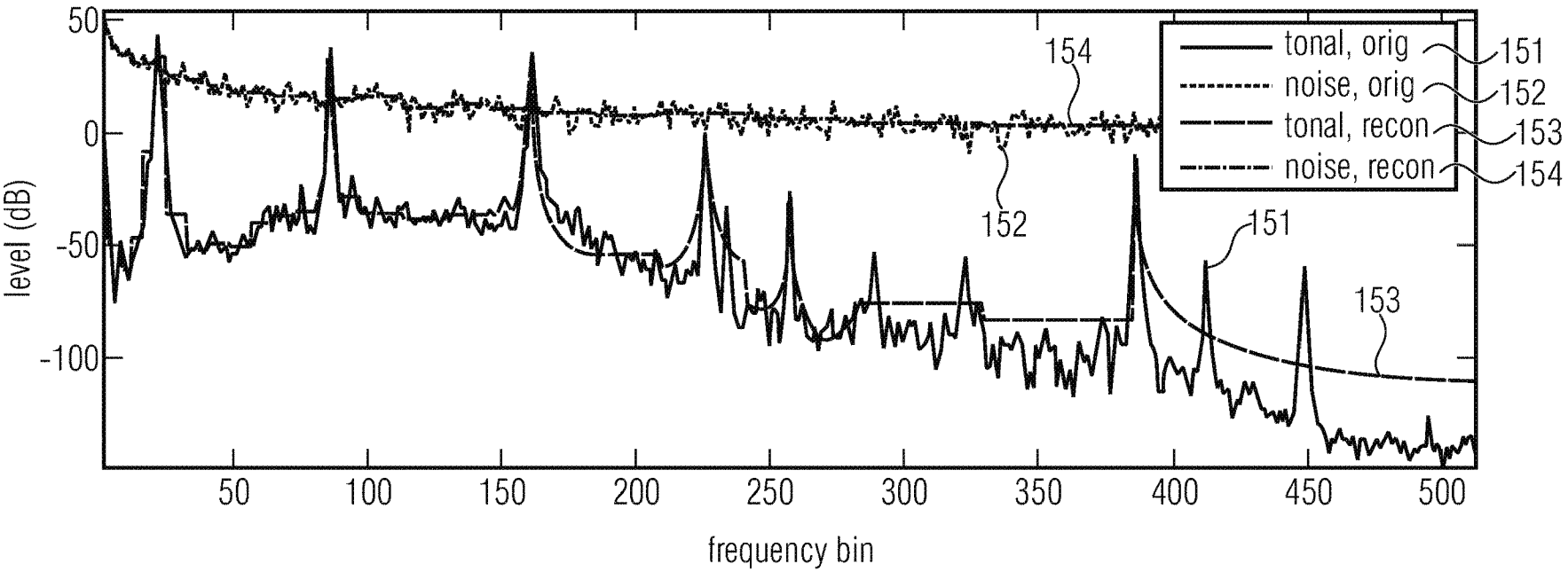
FIG. 18 illustrates the result of applying the modelled correction factors on the rough reconstructions.

FIG. 18 illustrates the result of applying the modeled correction factors on the rough reconstructions illustrated in FIG. 15. In particular, the power spectra of the original tonal signal 151 and the original noise signal 152, and the reconstructed power spectra estimates of the tonal signal 153 and the noise signal 154 are shown. These curves can now be used instead of OLDs in the following calculations, in particular, the reconstructed fine-resolution power spectra after applying the modeled correction factors. Here, the absolute energy information is included to make the comparison better visible, but the same principle works also without them.

The inventive method and apparatus alleviate the aforementioned drawbacks of the state of the art SAOC processing using a filter bank or time-frequency transform with a high frequency resolution and providing an efficient parameterization of the additional information. Furthermore, it is possible to transmit this additional information in such a way that the standard SAOC-decoders can decode the backwards compatible portion of the information at a quality obtainable comparable to the one obtained using a standard-conformant SAOC encoder, and still allow the enhanced decoders to utilize the additional information for a better perceptual quality. Most importantly, the additional information can be represented in a very compact manner for efficient transmission or storage.

The presented inventive method can be applied on any SAOC scheme. It can be combined with any current and also future audio formats. The inventive method allows for enhanced perceptual audio quality in SAOC applications by a two-level representation of spectral side information.

The same idea can be used also in conjunction with MPEG Surround when replacing the concept of OLDs with channel-level differences (CLDs).

An audio encoder or method of audio encoding or related computer program as described above is provided. Moreover, an audio encoder or method of audio decoding or related computer program as described above is provided. Furthermore, an encoded audio signal or storage medium having stored the encoded audio signal as described above is provided.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[BCC] C. Faller and F. Baumgarte, "Binaural Cue Coding—Part II: Schemes and applications," IEEE Trans. on Speech and Audio Proc., vol. 11, no. 6, November 2003.

[JSC] C. Faller, "Parametric Joint-Coding of Audio Sources", 120th AES Convention, Paris, 2006.

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April 2007.

[SAOC2] J. Engdegård, B. Resch, C. Falch, O. Hellmuth, J. Hilpert, A. Holzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam, 2008.

[SAOC] ISO/IEC, "MPEG audio technologies—Part 2: Spatial Audio Object Coding (SAOC)," ISO/IEC JTC1/SC29/WG11 (MPEG) International Standard 23003-2:2010.

[AAC] M. Bosi, K. Brandenburg, S. Quackenbush, L. Fielder, K. Akagiri, H. Fuchs, M. Dietz, "ISO/IEC MPEG-2 Advanced Audio Coding", J. Audio Eng. Soc, vol 45, no 10, pp. 789-814, 1997.

[ISS1] M. Parvaix and L. Girin: "Informed Source Separation of underdetermined instantaneous Stereo Mixtures using Source Index Embedding", IEEE ICASSP, 2010.

[ISS2] M. Parvaix, L. Girin, J.-M. Brossier: "A watermarking-based method for informed source separation of audio signals with a single sensor", IEEE Transactions on Audio, Speech and Language Processing, 2010.

[ISS3] A. Liutkus and J. Pinel and R. Badeau and L. Girin and G. Richard: "Informed source separation through spectrogram coding and data embedding", Signal Processing Journal, 2011.

[ISS4] A. Ozerov, A. Liutkus, R. Badeau, G. Richard: "Informed source separation: source coding meets source separation", IEEE Workshop on Applications of Signal Processing to Audio and Acoustics, 2011.

[ISS5] S. Zhang and L. Girin: "An Informed Source Separation System for Speech Signals", INTERSPEECH, 2011.

[ISS6] L. Girin and J. Pinel: "Informed Audio Source Separation from Compressed Linear Stereo Mixtures", AES 42nd International Conference: Semantic Audio, 2011.

[ISS7] A. Nesbit, E. Vincent, and M. D. Plumbley: "Benchmarking flexible adaptive time-frequency transforms for underdetermined audio source separation", IEEE International Conference on Acoustics, Speech and Signal Processing, pp. 37-40, 2009.

The invention claimed is:

1. An audio decoder for generating an un-mixed audio signal comprising a plurality of un-mixed audio channels, wherein the audio decoder comprises:

an un-mixing-information determiner for determining un-mixing information for a downmix signal by receiving first parametric side information on the at least one audio object signal with a first frequency resolution and by receiving second parametric side information on the at least one audio object signal with a second frequency resolution being greater than the first frequency resolution, and an un-mix module for applying the un-mixing information on the downmix signal, indicating a downmix of at least one audio object signal, to generate an un-mixed audio signal comprising the plurality of un-mixed audio channels, wherein the un-mixing-information determiner is configured to determine the un-mixing information using the first parametric information and the second parametric information to acquire modified parametric information, such that the modified parametric information comprises a frequency resolution which is greater than the first frequency resolution, wherein the audio decoder is implemented using a hardware apparatus or using a computer or using a combination of a hardware apparatus and a computer.

2. An audio decoder according to claim 1, wherein the audio decoder further comprises a first transform unit for transforming a downmix input, being represented in a time domain, to acquire the downmix signal, being represented in a time-frequency domain, and wherein the audio decoder comprises a second transform unit for transforming the un-mixed audio signal from the time-frequency domain to the time domain.

3. An audio decoder according to claim 1, wherein the un-mixing-information determiner is configured to determine the un-mixing information by combining the first parametric information and the second parametric information to acquire the modified parametric information, such that the modified parametric information comprises a frequency resolution which is equal to the second frequency resolution.

4. An audio decoder according to claim 1, wherein the first parametric information comprises a plurality of first parameter values, wherein the second parametric information comprises a plurality of second parameter values, wherein the un-mixing-information determiner comprises a frequency-resolution-conversion subunit and a combiner, wherein the frequency-resolution-conversion unit is configured to generate additional parameter values, wherein the first parameter values and the additional parameter values together form a plurality of first processed parameter values, and wherein the combiner is configured to combine the first processed parameter values and the second parameter values to acquire a plurality of modified parameter values as the modified parametric information.

5. An audio decoder according to claim 1, wherein the un-mixing-information determiner comprises a delta-function-recovery unit and a delta-application unit, wherein the first parametric information comprises a plurality of parametric values depending on the at least one audio object signal, and wherein the second parametric information comprises a correction factor parameterization, wherein the delta-function-recovery unit is configured to invert the correction factor parameterization to acquire a delta function, and wherein the delta-application unit is configured to apply the delta function on the parametric values to determine the un-mixing information.

6. An audio decoder according to claim 5, wherein the correction factor parameterization comprises a plurality of linear prediction coefficients, wherein the delta-function-recovery unit is configured to invert the correction factor parameterization by generating a plurality of correction factors depending on the plurality of linear prediction coefficients, and wherein the delta-function-recovery unit is configured to generate the delta function based on the plurality of correction factors.

7. An audio decoder according to claim 1, wherein the audio decoder further comprises an un-mixing-matrix generator for generating an un-mixing matrix depending on the first parametric side information, depending on the second parametric side information, and depending on rendering information, and wherein the un-mix module is configured to apply the un-mixing matrix on the transformed downmix to acquire the un-mixed audio signal.

8. An audio decoder according to claim 1, wherein the un-mix module comprises a decorrelation unit and an un-mixing unit, wherein the decorrelation unit is configured to conduct decorrelation on the transformed downmix to acquire a decorrelation result, and wherein the un-mixing unit is configured to employ the decorrelation result to acquire the un-mixed audio signal.

9. An audio encoder for encoding one or more input audio object signals, comprising:

a downmix unit for downmixing the one or more input audio object signals to acquire one or more downmix signals, and a parametric-side-information generator for generating first parametric side information on the at least one audio object signal and second parametric side information on the at least one audio object signal, such that the frequency resolution of the second parametric side information is higher than the frequency resolution of the first parametric side information, wherein the audio encoder is implemented using a hardware apparatus or using a computer or using a combination of a hardware apparatus and a computer.

10. An audio encoder according to claim 9, wherein the audio encoder further comprises a transform unit for transforming the one or more input audio object signals from a time domain to a time-frequency domain to acquire one or more transformed audio object signals, and wherein the parametric-side-information generator is configured to generate the first parametric side information and the second parametric side information based on the one or more transformed audio object signals.

11. An audio encoder according to claim 10, wherein the transform unit is configured to transform the one or more input audio object signals from the time domain to the time-frequency domain depending on a window length of a signal transform block comprising signal values of at least one of the one or more input audio object signals, wherein the transform unit comprises a transient-detection unit for determining a transient detection result indicating whether a transient is present in one or more of the at least one audio object signals, wherein a transient indicates a signal change in one or more of the at least one audio object signals, and wherein the transform unit further comprises a window sequence unit for determining the window length depending on the transient detection result.

12. An audio encoder according to claim 9, wherein the audio encoder further comprises a delta-estimation unit for estimating a plurality of correction factors based on a plurality of parametric values depending on the at least one audio object signal to acquire the second parametric side information.

13. An audio encoder according to claim 12, wherein the audio encoder further comprises a delta modelling unit for determining linear prediction coefficients from the plurality of correction factors by conducting a linear prediction.

14. A non-transitory computer-readable medium having stored thereon a computer-readable representation of an encoded audio signal, wherein the encoded audio signal comprises:

a downmix portion indicating a downmix of one or more input audio object signals, a parametric side information portion comprising first parametric side information on the at least one audio object signal and second parametric side information on the at least one audio object signal, wherein the frequency resolution of the second parametric side information is higher than the frequency resolution of the first parametric side information.

15. A system comprising:

an audio encoder according to claim 9 for encoding one or more input audio object signals by acquiring one or more downmix signals indicating a downmix of the one or more input audio object signals, by acquiring first parametric side information on the at least one audio object signal, and by acquiring second parametric side information on the at least one audio object signal, wherein the frequency resolution of the second parametric side information is higher than the frequency resolution of the first parametric side information, and an audio decoder for generating an un-mixed audio signal based on the one or more downmix signals, and based on the first parametric side information and the second parametric side information, wherein the un-mixed audio signal comprises a plurality of un-mixed audio channels, wherein the audio decoder comprises:

an un-mixing-information determiner for determining un-mixing information for a downmix signal by receiving the first parametric side information on the at least one audio object signal with a first frequency resolution and by receiving the second parametric side information on the at least one audio object signal with a second frequency resolution being greater than the first frequency resolution, and an un-mix module for applying the un-mixing information on the downmix signal, indicating a downmix of at least one audio object signal, to generate an un-mixed audio signal comprising the plurality of un-mixed audio channels, wherein the un-mixing-information determiner is configured to determine the un-mixing information using the first parametric information and the second parametric information to acquire modified parametric information, such that the modified parametric information comprises a frequency resolution which is greater than the first frequency resolution, wherein the audio decoder is implemented using a hardware apparatus or using a computer or using a combination of a hardware apparatus and a computer.

16. A method for generating, by an audio decoder, an un-mixed audio signal comprising a plurality of un-mixed audio channels, wherein the method comprises:

determining un-mixing information for a downmix signal by receiving first parametric side information on the at least one audio object signal with a first frequency resolution and by receiving second parametric side information on the at least one audio object signal with a second frequency resolution being greater than the first frequency resolution, and applying the un-mixing information on the downmix signal, indicating a downmix of at least one audio object signal, to generate an un-mixed audio signal comprising the plurality of un-mixed audio channels, wherein the determining the un-mixing information is conducted using the first parametric information and the second parametric information to acquire modified parametric information, such that the modified parametric information comprises a frequency resolution which is greater than the first frequency resolution, wherein the method is performed using a hardware apparatus or using a computer or using a combination of a hardware apparatus and a computer.

17. A method for encoding one or more input audio object signals by an audio encoder, comprising:

downmixing, by a downmix unit, the one or more input audio object signals to acquire one or more downmix signals, and generating, by a parametric-side-information generator, first parametric side information on the at least one audio object signal and second parametric side information on the at least one audio object signal, such that the frequency resolution of the second parametric side information is higher than the frequency resolution of the first parametric side information, wherein the method is performed using a hardware apparatus or using a computer or using a combination of a hardware apparatus and a computer.

18. A non-transitory computer-readable medium comprising a computer program for implementing the method of claim 16 when being executed on a computer or signal processor.

19. A non-transitory computer-readable medium comprising a computer program for implementing the method of claim 17 when being executed on a computer or signal processor.

* * * * *